US011519219B2

(12) United States Patent
Everett

(10) Patent No.: US 11,519,219 B2
(45) Date of Patent: Dec. 6, 2022

(54) SECURE SLIDING DOOR

(71) Applicant: KDB Intellectual Pty Ltd, Queanbeyan East (AU)

(72) Inventor: Timothy Riva Everett, Balwyn North (AU)

(73) Assignee: KDB Intellectual Pty Ltd, Queanbeyan East (AU)

( * ) Notice: Subject to any disclaimer, the term of this patent is extended or adjusted under 35 U.S.C. 154(b) by 28 days.

(21) Appl. No.: 16/937,461

(22) Filed: Jul. 23, 2020

(65) Prior Publication Data

US 2022/0003037 A1 Jan. 6, 2022

(30) Foreign Application Priority Data

Jul. 3, 2020 (AU) ..... 2020204466

(51) Int. Cl.

| | |
|---|---|
| ***E06B 5/11*** | (2006.01) |
| ***E06B 3/46*** | (2006.01) |
| ***E06B 5/20*** | (2006.01) |
| ***E06B 1/16*** | (2006.01) |

(52) U.S. Cl.

CPC ..... *E06B 5/11* (2013.01); *E06B 1/16* (2013.01); *E06B 3/4654* (2013.01); *E06B 5/20* (2013.01)

(58) Field of Classification Search

CPC . E06B 5/11; E06B 3/4654; E06B 1/52; E06B 1/12; E06B 1/16; E05Y 2900/14

USPC ..... 49/228, 370, 372

See application file for complete search history.

(56) References Cited

U.S. PATENT DOCUMENTS 2,026,886 A 1/1936 Goeltz et al.
2,220,400 A 11/1940 Faris
2,561,079 A * 7/1951 Trammell, Sr. ..... E06B 3/4654 49/372
2,732,919 A * 1/1956 Johnson, Jr. ..... E05D 15/0652 49/372

(Continued)

FOREIGN PATENT DOCUMENTS

AU 2011202561 A1 12/2011
AU 2012100387 A4 5/2012

(Continued)

OTHER PUBLICATIONS

IP Australia, Examination Report Issued in Application No. 2020204466, dated Aug. 25, 2020, 9 pages.

(Continued)

*Primary Examiner* — Justin B Rephann
(74) *Attorney, Agent, or Firm* — McCoy Russell LLP

(57) ABSTRACT

A secure sliding closure having a modular frame and one or more sliding door is described. The modular frame defines at least one secure cavity and a portal and comprises a main frame and at least one door frame. The main frame comprises at least one frame upright spaced apart from at least one portal upright and a respective at least one top plate extending between the at least one frame upright and the at least one portal upright. The at least one door frame comprising a locking side upright spaced apart from a secure cavity upright and a door frame top plate. The modular frame defines at least one secure cavity and defines a portal. The one or more sliding door comprises a sliding leaf and a sliding leaf covering, the covering comprising one or more sliding door security panel.

13 Claims, 26 Drawing Sheets

(56) References Cited

U.S. PATENT DOCUMENTS 3,091,004 A * 5/1963 Mays ..... E06B 3/4654 49/372
3,494,076 A * 2/1970 Todd ..... E06B 3/4654 49/505
4,063,389 A * 12/1977 Leder ..... E05B 65/0864 49/370
4,325,204 A * 4/1982 Martine ..... E06B 3/4654 49/372
4,370,831 A * 2/1983 Hamilton ..... H05K 9/0015 174/375
4,385,470 A * 5/1983 Bryson ..... E06B 5/11 49/372
4,742,645 A * 5/1988 Johnston ..... E06B 3/4654 49/372
5,335,464 A * 8/1994 Vanesky ..... A61B 5/242 52/173.1
6,058,655 A * 5/2000 Gravel ..... B60P 7/14 49/306
6,289,643 B1 * 9/2001 Bonar ..... E06B 3/4654 49/505
6,629,713 B1 * 10/2003 Duffy ..... E05B 65/087 292/332
8,517,434 B1 * 8/2013 Reep, Sr. ..... E05B 17/2038 292/65
10,648,221 B2 * 5/2020 Liu ..... E06B 3/4654
10,900,268 B2 * 1/2021 Colligan ..... E05B 65/0876
2006/0168894 A1 * 8/2006 Gorjian ..... E06B 3/4654 49/410
2014/0075863 A1 * 3/2014 Laronde ..... E06B 1/045 52/217
2017/0051554 A1 * 2/2017 Dastrup ..... E05D 15/0656
2017/0362881 A1 * 12/2017 Gosling ..... E05F 1/16
2018/0209192 A1 * 7/2018 Selvaag ..... E05D 15/0626
2018/0238101 A1 * 8/2018 Monaghan ..... E06B 3/4654
2019/0162002 A1 * 5/2019 Colligan ..... E05D 15/0643
2019/0178022 A1 * 6/2019 Liu ..... E06B 3/4654

FOREIGN PATENT DOCUMENTS

AU 2018237281 A1 5/2019
EP 3591155 A1 1/2020
GB 2312231 A 10/1997
WO 2011088558 A1 7/2011
WO 2014026268 A1 2/2014

OTHER PUBLICATIONS

IP Australia, Examination Report Issued in Application No. 2020204466, dated Jul. 19, 2021, 8 pages.

* cited by examiner

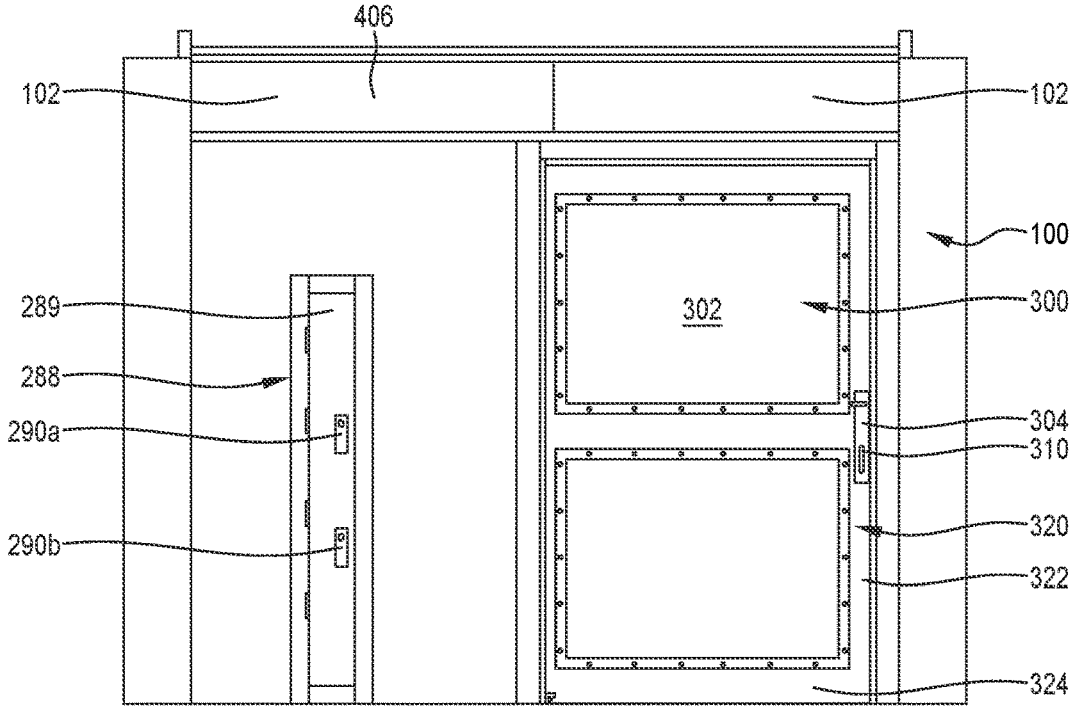
Figure 1A (SECURE SIDE)
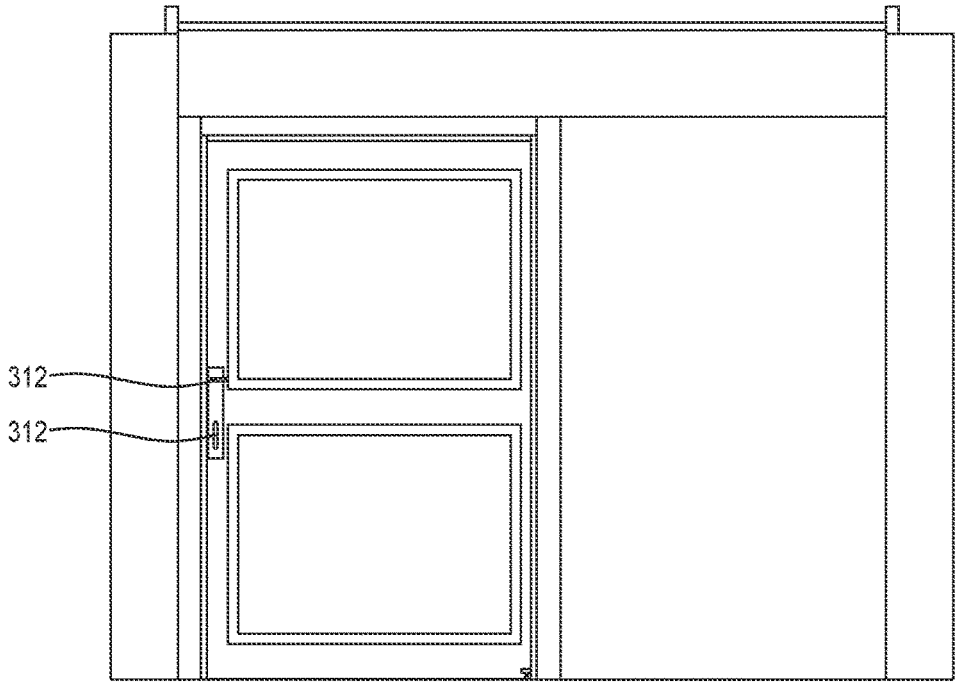
Figure 1B (ATTACK SIDE)

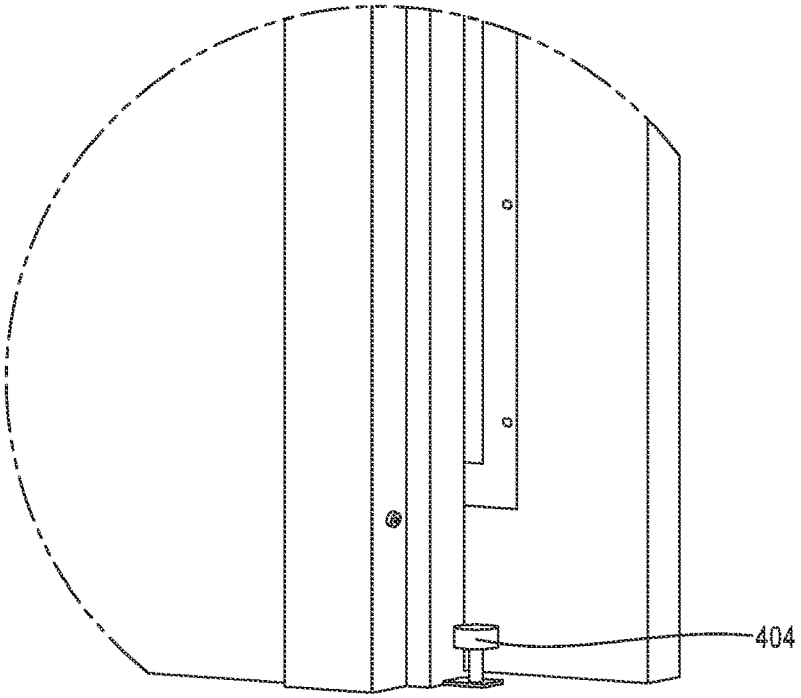
Figure 2C (ATTACK SIDE)
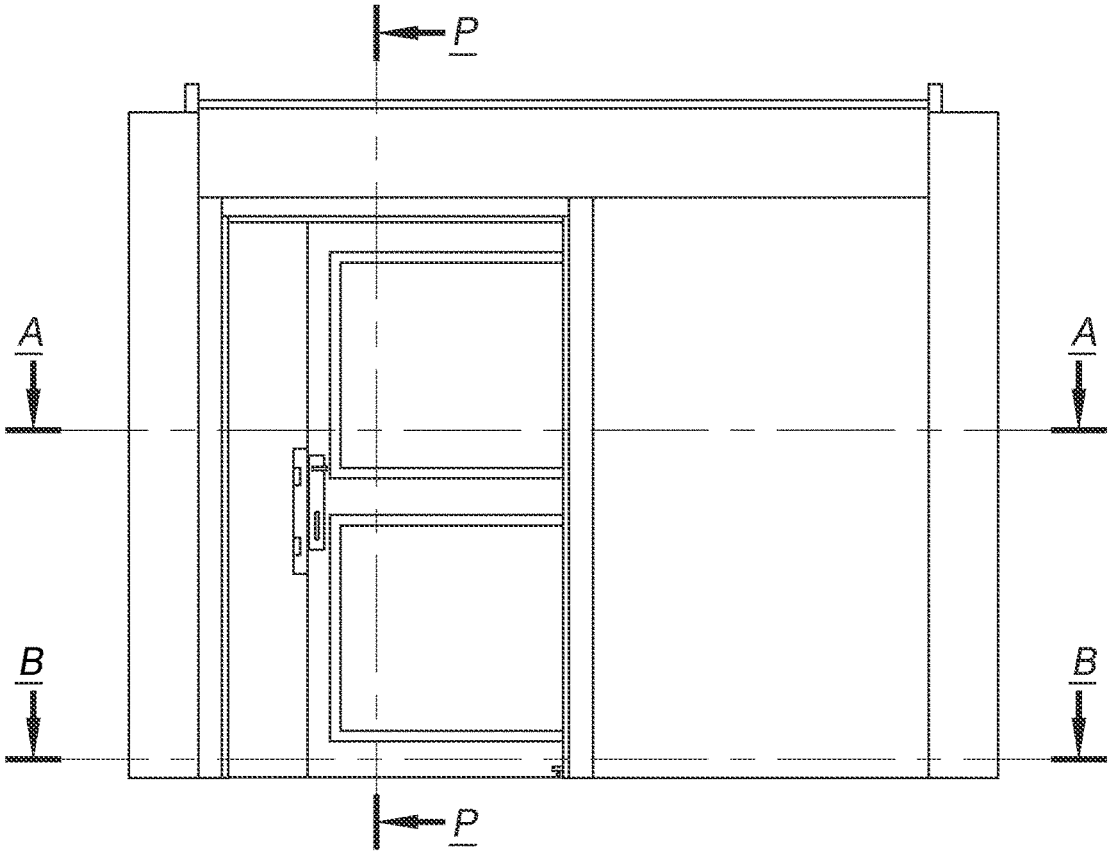
Figure 3A (ATTACK SIDE)

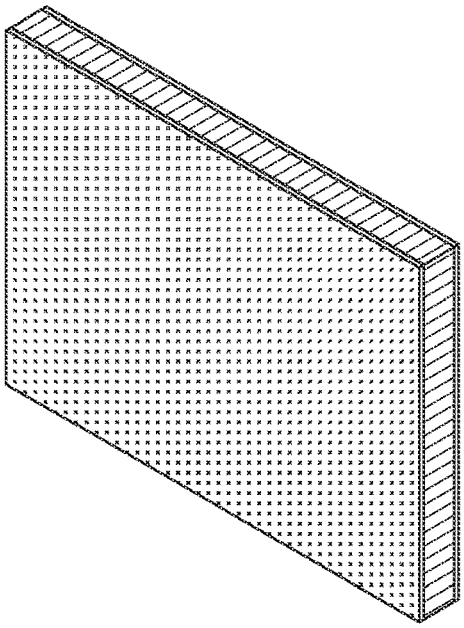
Figure 5A(i)
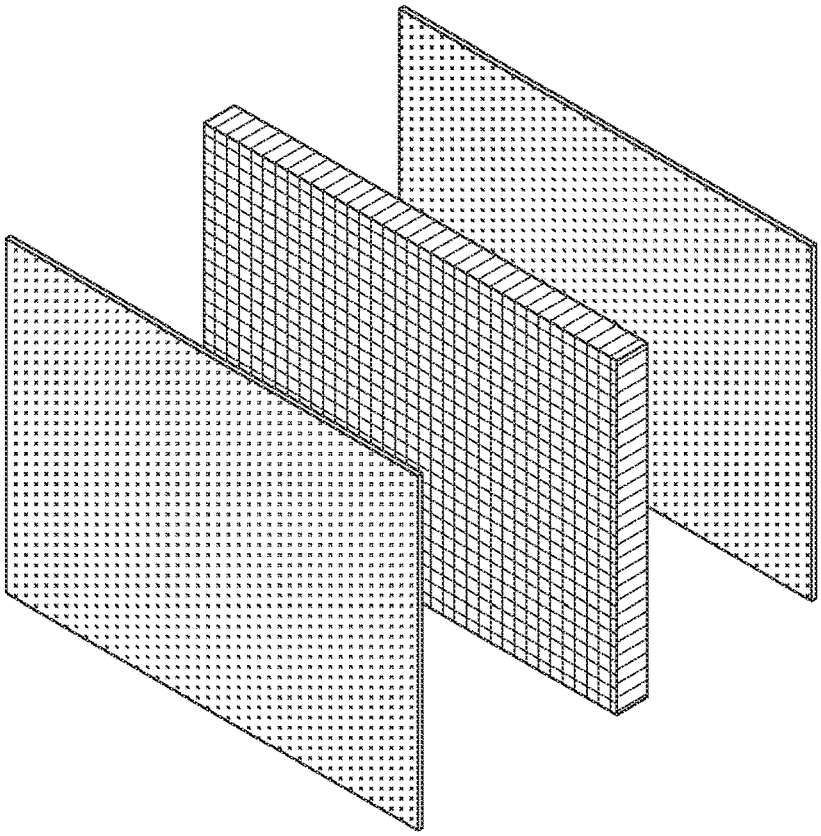
Figure 5A(ii)

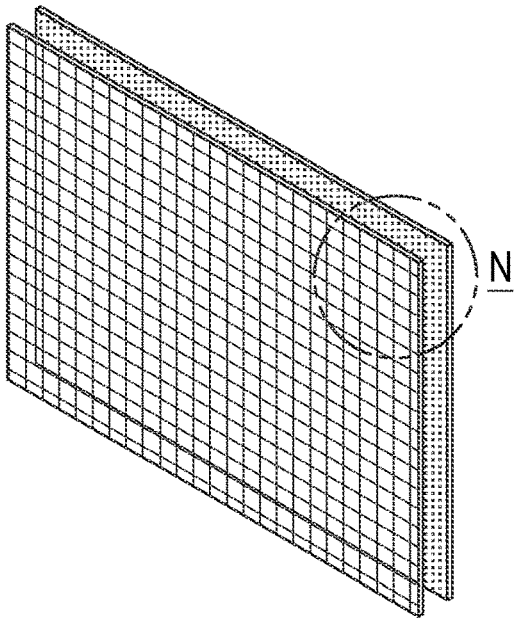
Figure 5B(i)
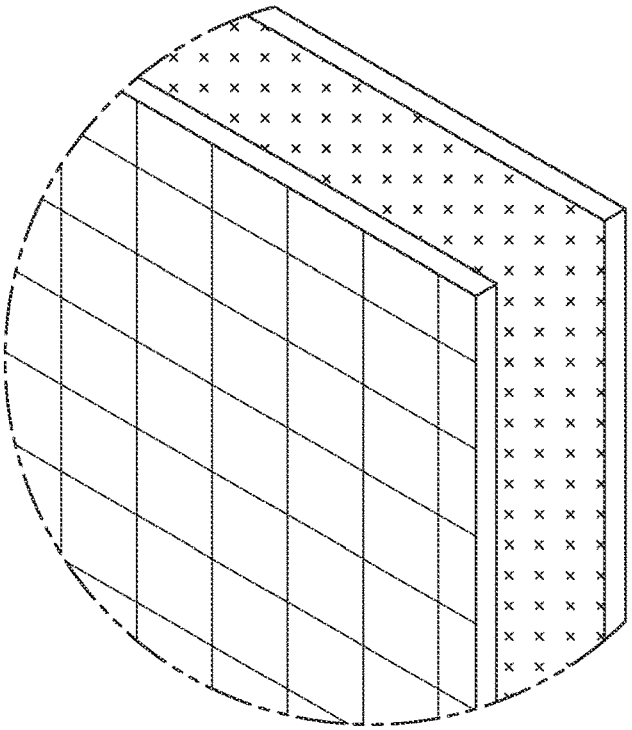
Figure 5B(ii)

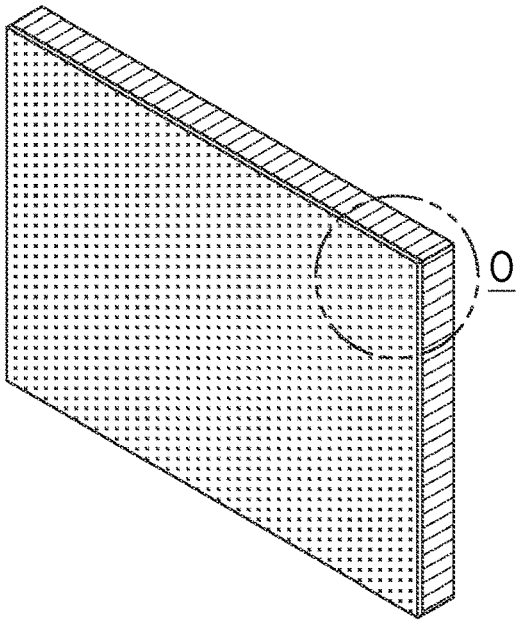
*Figure 5C(i)*
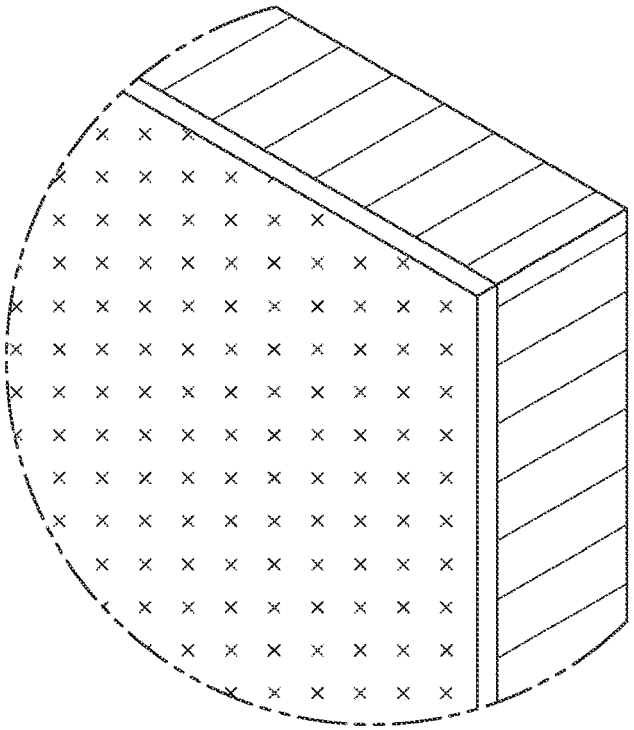
*Figure 5C(ii)*

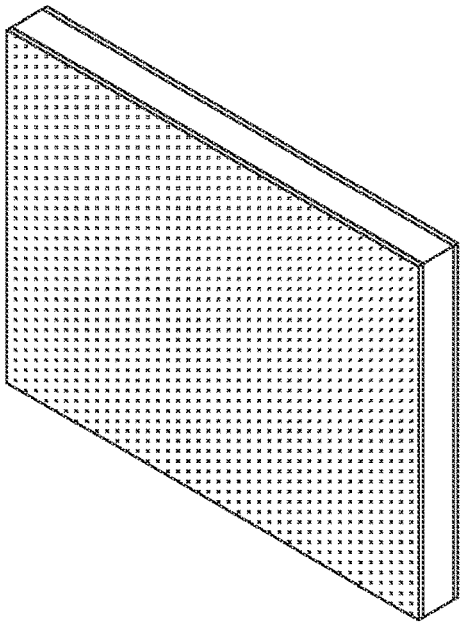
Figure 5D(i)
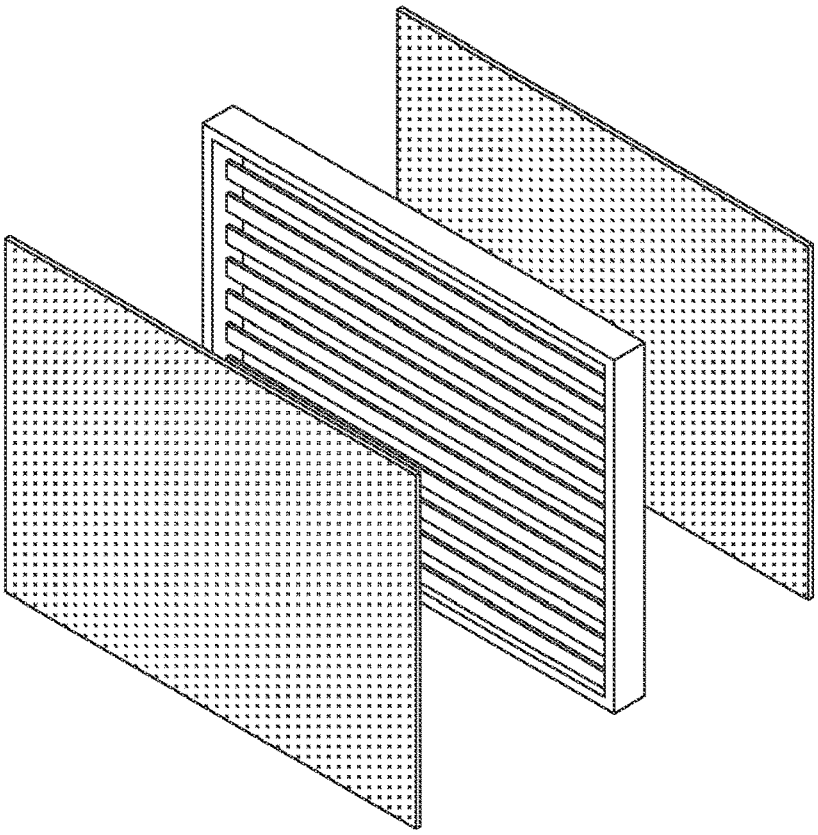
Figure 5D(ii)

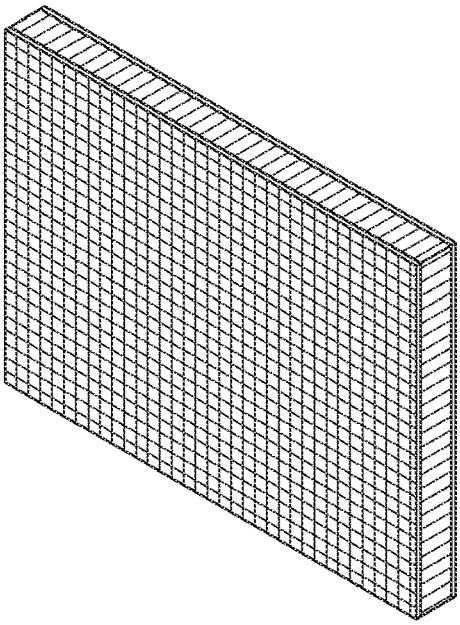
Figure 5E(i)
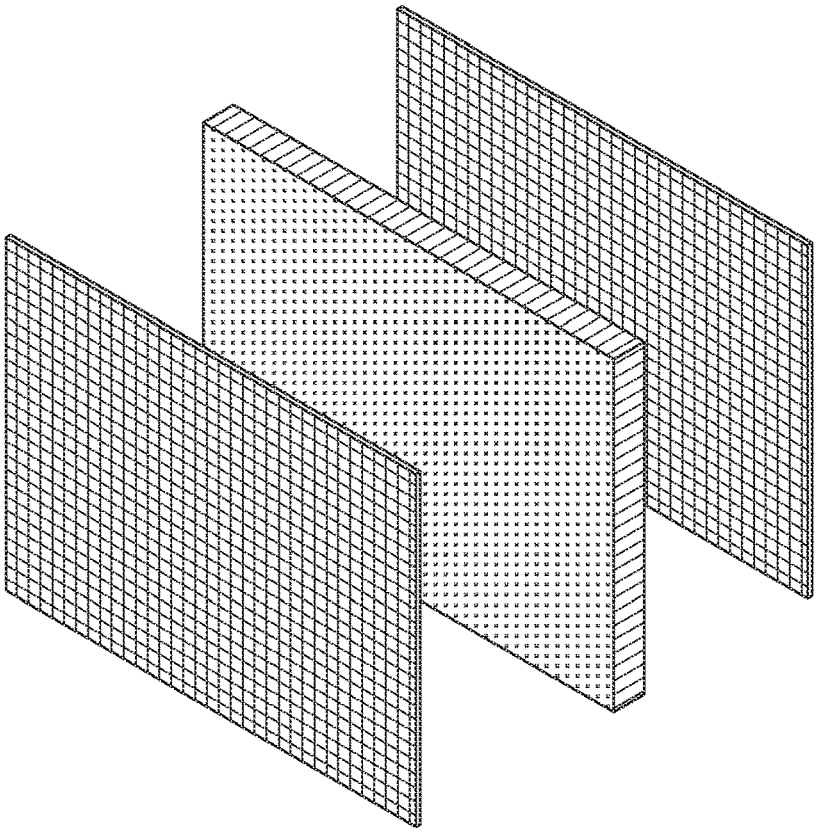
Figure 5E(ii)

SECURE SLIDING DOOR

CROSS-REFERENCE TO RELATED APPLICATION

The present application claims priority to Australian Patent Application No. 2020204466 filed on Jul. 3, 2020. The entire contents of the above-listed application is hereby incorporated by reference for all purposes.

TECHNICAL FIELD

The present invention relates to secure sliding closure comprising a modular frame. More particularly, this invention relates to a secure sliding closure comprising a modular frame defining a secure cavity and a portal and one or more sliding leaf comprising a secure leaf frame and one or more security panel.

BACKGROUND

Closures such as, doors and windows, provide a means of securely controlling access to buildings and specific rooms.

Australian Patent No 2011202561 describes a door suitable for use in some circumstances requiring an increased level of security. The door comprises a framework constructed by welding tougher door framework members to create a door frame housing a recessed region in which the lock or locks are mounted. The framework is sandwiched between two door panels that are rigidly attached the frame.

When space is limited, sliding doors are appealing due to their smaller footprint, that is, the panel slides between a cavity and the portal rather than swinging in and out of the room or hallway.

Sliding closures present security challenges due to the requisite engineering of the panel and framework to house the panel. There remains a need for a secure sliding closure.

The reference to any prior art in this specification is not, and should not be taken as, an acknowledgement or any form of suggestion that the prior art forms part of the common general knowledge.

SUMMARY

Generally, embodiments of the present invention relate to secure sliding closure comprising a modular frame.

In a broad form, the invention relates to a secure sliding closure comprising a modular frame defining a secure cavity and a portal and one or more sliding leaf comprising a secure leaf frame and one or more security panel.

In a first aspect, although it need not be the only or indeed the broadest aspect, the invention provides a secure sliding closure comprising:

a modular frame defining at least one secure cavity and a portal, the modular frame comprising a main frame and at least one door frame, the main frame comprising at least one frame upright spaced apart from at least one portal upright and a respective at least one top plate extending between the at least one frame upright and the at least one portal upright, the at least one door frame comprising a locking side upright spaced apart from a secure cavity upright and a door frame top plate extending between the locking side upright and the secure cavity upright, the modular frame defining at least one secure cavity between a respective at least one frame upright and secure cavity upright and defining a portal between respective secure cavity upright and locking side upright; and one or more sliding door comprising a sliding leaf and a sliding leaf covering disposed on the sliding leaf, the covering comprising one or more sliding door security panel, the sliding leaf disposed for sliding from within the secure cavity to across the portal to prevent access through the portal.

In a second aspect, the invention provides a method of manufacturing a secure sliding closure, the method comprising:

producing a modular frame defining at least one secure cavity and a portal, the modular frame comprising a main frame and at least one door frame, the main frame comprising at least one frame upright spaced apart from at least one portal upright and a respective at least one top plate extending between the at least one frame upright and the at least one portal upright, the at least one door frame comprising a locking side upright spaced apart from a secure cavity upright and a door frame top plate extending between the locking side upright and the secure cavity upright, the modular frame defining at least one secure cavity between a respective at least one frame upright and secure cavity upright and defining a portal between respective secure cavity upright and locking side upright; and making one or more sliding door comprising a sliding leaf and a sliding leaf covering disposed on the sliding leaf, the covering comprising one or more sliding door security panel, the sliding leaf disposed for sliding from within the secure cavity to across the portal to prevent access through the portal.

In a third aspect, the invention provides a method of installing or retrofitting a secure sliding closure, the method comprising:

installing or retrofitting a modular frame defining at least one secure cavity and a portal, the modular frame comprising a main frame and at least one door frame, the main frame comprising at least one frame upright spaced apart from at least one portal upright and a respective at least one top plate extending between the at least one frame upright and the at least one portal upright, the at least one door frame comprising a locking side upright spaced apart from a secure cavity upright and a door frame top plate extending between the locking side upright and the secure cavity upright, the modular frame defining at least one secure cavity between a respective at least one frame upright and secure cavity upright and defining a portal between respective secure cavity upright and locking side upright; and installing or retrofitting one or more sliding door comprising a sliding leaf and a sliding leaf covering disposed on the sliding leaf, the covering comprising one or more sliding door security panel, the sliding leaf disposed for sliding from within the secure cavity to across the portal to prevent access through the portal.

In a fourth aspect, the invention provides a kit for a secure sliding closure, the kit comprising:

a modular frame defining at least one secure cavity and a portal, the modular frame comprising a main frame and at least one door frame, the main frame comprising at least one frame upright spaced apart from at least one portal upright and a respective at least one top plate extending between the at least one frame upright and the at least one portal upright, the at least one door frame comprising a locking side upright spaced apart from a secure cavity upright and a door frame top plate extending between the locking side upright and the secure cavity upright, the modular frame defining at least one secure cavity between a respective at least one frame upright and secure cavity upright and defining a portal between respective secure cavity upright and locking side upright; and one or more sliding door comprising a sliding leaf and a sliding leaf covering disposed on the sliding leaf, the covering comprising one or more sliding door security panel, the sliding leaf disposed for sliding from within the secure cavity to across the portal to prevent access through the portal.

In a fifth aspect, the invention provides a method of securing access to one or more room or area, the method comprising:

installing a secure sliding closure, the secure sliding closure comprising:

a modular frame defining at least one secure cavity and a portal, the modular frame comprising a main frame and at least one door frame, the main frame comprising at least one frame upright spaced apart from at least one portal upright and a respective at least one top plate extending between the at least one frame upright and the at least one portal upright, the at least one door frame comprising a locking side upright spaced apart from a secure cavity upright and a door frame top plate extending between the locking side upright and the secure cavity upright, the modular frame defining at least one secure cavity between a respective at least one frame upright and secure cavity upright and defining a portal between respective secure cavity upright and locking side upright; and one or more sliding door comprising a sliding leaf and a sliding leaf covering disposed on the sliding leaf, the covering comprising one or more sliding door security panel, the sliding leaf disposed for sliding from within the secure cavity to across the portal to prevent access through the portal.

According to any one of the above aspects, the one or more sliding door may comprise double sliding doors. When double sliding doors are comprised, the modular frame may comprise respective left and right secure cavities and a central portal, the modular frame comprising respective left and right main frames and left and right sliding leaf frames.

In one embodiment of any one of the above aspects, the secure sliding closure may be comprised in a vault such as, a digital vault. When the secure sliding closure is comprised in a vault, the vault may comprise one or more of: one or more visual alarm disposed on the attack side; one or more aural alarm for activation on the attack side such as, a hand operated bell; and a switch for activation of the visual alarm and/or aural alarm on the secure side. The visual alarm may comprise one or more light such as a strobe light, optionally a red strobe light. When the secure sliding closure is comprised in a vault, the attack side may comprise a swing door. The swing door may comprise a main leaf and an auxiliary leaf. The main leaf may comprise a magnetic lock and/or an electric strike or lock. The auxiliary leaf may comprise one or more lock bolts such as, a top lock bolt and bottom lock bolt.

In another embodiment according to any one of the above aspects, the secure sliding closure may further comprise a threshold. The threshold may comprise a threshold bottom plate disposed underneath the sliding leaf. The threshold bottom plate may comprise a seal. The seal may comprise one or more guide. The one or more guide may be biased, optionally the one or more guides are spring loaded. The threshold may comprise a central channel and an attack side flange and a secure side flange on respective sides of the central channel.

In still another embodiment according to any one of the above aspects, the frame upright and/or the portal upright may comprise a stud and a support post. The stud may comprise a heavy gauge steel stud.

In one embodiment of any one of the above aspects, the main frame may further comprise a bottom plate extending between the frame upright and the secure cavity upright or between the frame upright and the portal upright. The bottom plate may be fastened to the floor. The bottom plate fasteners may comprise floor fixings such as cavity pocket stagger bolts. The bottom plate fasteners may comprise 1; 2; 3; 4; 5; 6; 7; 8; 9; 10; 11; 12; 15; or 20 cavity pocket stagger bolts. In one particular embodiment, 8 bottom plate fasteners are comprised.

The main frame according to any one of the above aspects may further comprise one or more mounting member. Each one or more mounting member may be mounted to the floor or the soffit. The one or more mounting member may comprise a frame upright head mounting member and a portal upright head mounting member. The one or more mounting member may further comprise a frame upright floor mounting member and a portal upright floor mounting member. The mounting member may comprise dimensions of 150×50 mm. Each of the one or more mounting member may be mounted to the frame upright and/or the top plate; the portal upright and/or the top plate; the frame upright and/or the bottom plate; or the portal upright and/or the bottom plate. The one or more mounting member may be mounted with suitable fasteners.

In another embodiment according to any one of the above aspects, the main frame may further be fastened to the floor with one or more main frame floor fastener such as, one or more frame upright floor fastener and one or more portal upright floor fastener. The main frame floor fasteners may comprise floor fixings such as cavity pocket stagger bolts. The main frame floor fasteners may comprise 1; 2; 3; 4; 5; 6; 7; 8; 9; 10; 11; 12; 15; or 20 cavity pocket stagger bolts. In one particular embodiment, two frame upright floor fasteners and two portal upright floor fasteners are comprised.

The modular frame according to any one of the above aspects may comprise an attack side and a secure side. The main frame secure side may comprise a service door portal. The service door portal may be defined by a service door frame. The service door frame may comprise spaced apart service door uprights. The service door frame may further comprise one or more of a service door top plate and service door bottom plate.

According to any one of the above aspects, the modular frame attack side and/or the modular frame secure side may further comprise one or more modular frame security panel covering or partially covering the secure cavity and/or any other part of the secure sliding closure.

In another embodiment of any one of the above aspects, the main frame may further comprise a subframe. The subframe may comprise one or more horizontal members and one or more vertical members. The subframe may at least partially enclose the secure cavity.

The main frame according to any one of the above aspects, may further comprise a service door leaf. The service door leaf may comprise a solid door leaf. In one particular embodiment, the service door leaf may comprise a SAPD-SD-MO leaf. The service door leaf may comprise a 30; 40; 50; 60; 70; or 80 mm core. In a particular embodiment, the service door leaf comprises a 50 mm core.

The service door leaf may be attached to the service door frame with one or more hinges such as, one or more ball bearing hinge.

In yet another embodiment of any one of the above aspects, the service door may comprise one or more service door locks. The one or more service door locks may comprise an upper dead lock and a lower dead lock. The service door leaf may further comprise door furniture and one or more end plate. The service door leaf may further comprise one or more service door security panel.

In yet another embodiment of any one of the above aspects, the modular frame may house one or more frame mortice lock. Each of the one or more frame mortice lock may be disposed above and/or below the sliding leaf. The one or more frame mortice lock may comprise two frame mortice locks, a first frame mortice lock disposed at a frame upright end and a second frame mortice lock disposed at a portal upright end. Each of the frame mortice locks may comprise a Sliding Door Mortice Lock.

In still another embodiment of any one of the above aspects, the sliding door may comprise one or more sliding door lock body cavity. The sliding door lock body cavity may house a sliding door lock body. The lock body may comprise one or more sliding door locks. The one or more sliding door locks may engage with a door frame strikeplate disposed on the locking side upright. The one or more sliding door locks may comprise one or more sliding door mortice lock and/or one or more sliding door dead lock. In a particular embodiment, the one or more sliding door locks comprise a dead lock above a mortice lock. When two or more sliding door locks are present, they may be activated in concert with a multi lock release mechanism. In one particular embodiment, the multi lock release mechanism comprises a BM-SSDL2 from Bridgewater Multidoors. Each of the one or more sliding door locks may be locked and unlocked by an electric switch such as, a microswitch. The electric switch may be connected to a network and operated from a remote location. The sliding door may comprise one; two; three; four; five; six; seven; eight; or eight or more locks.

The strikeplate according to any one of the above aspects, may comprise one or more adjustable strike insert. A suitable adjustable strike insert is the MLMF 22 available from Bridgewater Multidoors.

The strikeplate may comprise an electronic strike.

Each of the sliding door security panel, service door security panel and modular frame security panel according to any one of the above aspects, may comprise one or more steel plate or steel sheet or one or more transparent or partially transparent sheet.

According to any one of the above aspects, each of the one or more sliding door security panel may further comprise one or more safety layer; one or more additional functional layer; one or more insert layer; and one or more structural layer. The safety layer may comprise a fire rated material. The additional functional layer may comprise an acoustic rated material. The one or more structural layer may comprise a wood; engineered wood; or polymeric layer such as, a Laminated Veneer Lumbar (LVL) layer. The one or more insert may further comprise a louvre layer such as, a steel louver. Suitable security panels may comprise: two steel plates sandwiching a LVL layer; a layer of toughened laminate; a layer of Hygard BR1250 ballistic grade sheet; two layers of steel mesh sandwiching a layer of steel louver; or two steel plates sandwiching a layer of fire rated panel.

In another embodiment of any one of the above aspects, the one or more transparent or partially transparent layer may allow a view of the other side. The transparent or partially transparent layer may comprise transparent armour. The transparent armour may comprise a strong and optically transparent material that is resistant to penetration by projectiles. The transparent amour may comprise one or more layer of toughened laminate and/or one or more layer of laminated polycarbonate. The one or more layer of toughened laminate may comprise one or more layer of 10.76 toughened laminated glass. The one or more layer of laminated polycarbonate may comprise one or more layer of Hygard BR1250 ballistic grade sheet.

In yet another embodiment of any one of the above aspects, each of the one or more sliding door security panel may be fastened to the sliding door with a suitable fastener on the secure side such as, one or more bolts. The one or more secure side fastener may extend through or into one of the one sliding door security panel. The secure side fastener may further comprise a fastener anchor such as, a threaded tube. The one or more secure side fastener may be fastened to a secure flat bar frame housing the one or more sliding door security panel. The one or more secure side fasteners may be on an outer edge of the sliding door.

In still another embodiment of any one of the above aspects, each of the one or more sliding door security panel may be fastened to the sliding door with a suitable fastener on the attack side such as, one or more bolts. The one or more attack side fastener may extend through or into one of the one or sliding door security panel. The one or more attack side fastener may be fastened to a secure flat bar frame housing the one or more sliding door security panel. The one or more attack side fastener may be on an inside edge of the sliding door. The one or more attack side fastener may be secured within drilled and/or tapped holes. The one or more sliding door security panel may also be secured with one or more weld. The one or more weld may comprise a plug weld. The one or more weld may be secured within respective drilled holes. The fasteners and welds may be alternated along the length of the flat bar frame.

The sliding door according to any one of the above aspects, may further comprise one or more sliding door frame lock. The one or more sliding door frame lock may comprise a sliding door frame lock bolt for extension into a floor cavity. The sliding door frame lock may be disposed at, on or near a sliding leaf cavity upright. A suitable sliding door lock is the LAS 8007si.

In another embodiment of any one of the above aspects, the sliding closure may further comprise a sliding door track. The sliding door track may be comprised in a sliding door track housing. The sliding door track housing may comprise a sliding door cover. The sliding door track may be fastened to the modular frame. The sliding door track may comprise one or more hangers for attachment of the sliding leaf. The sliding door track and sliding door housing may be disposed at a top of the secure sliding closure.

In another embodiment of any one of the above aspects, the secure sliding closure may further comprise one or more roller guide. The one or more roller guide may comprise one roller guide disposed on each side of the leaf. Each of the one or more roller guide may be disposed at a bottom of the modular frame.

In yet another embodiment of any one of the above aspects, the sliding door may further comprise an automatic door operator to open and close the sliding leaf. The automatic door operator may be fixed to the modular frame. The automatic door operator may comprise a Dorma AL501 SA2 automatic door operator. The automatic door operator may be connected to a network for remote operation. The automatic door operator may be operatively connected to a card or key reader for opening and/or closing and/or to a secure lock actuator for secure locking.

The sliding leaf according to any one of the above aspects may comprise an attack side and a secure side. Each of the attack side and the secure side may comprise a sliding door security panel.

In another embodiment of any one of the above aspects, the sliding leaf may comprise a sliding leaf frame. The sliding leaf frame may comprise one or more sliding leaf frame uprights and one or more sliding leaf crossmembers.

In still another embodiment of any one of the above aspects, the sliding leaf frame may further comprise a flat bar frame. The flat bar frame may frame one or more of the one or more security panel.

In yet another embodiment of any one of the above aspects, the one or more security panel (modular frame security panel; sliding door security panel; service door security panel) or frame (modular frame; main frame; door frame; and service door frame) may be overlaid or partially overlaid with a decorative covering. The decorative covering may comprise one or more plasterboard layers and/or one or more sheet of ply. The one or more plasterboard layers may comprise an outermost covering of the cavity, on one or both of the secure side and attack side. The decorative covering may further comprise a removable pelmet.

Any above steel plate or steel sheet or ply sheet may comprise a thickness of 1; 2; 3; 4; 5; 6; 7; 8; 9; 10; 11; 12; 13; 14; 15; 20 or 25 mm. In one particular embodiment, the steel plate or steel sheet comprises an 8 mm steel plate or steel sheet. In another particular embodiment, the ply sheet comprises 9 mm ply sheet. Any one of the steel plates or steel sheets or ply sheets may be welded and/or bolted onto the modular frame; to the sliding leaf; or service door frame; or one or more component of the modular frame; the sliding leaf; or service door frame.

Any above security panel or decorative covering may overlay the modular frame; sliding leaf; or service door frame; or one or more component of the modular frame; the sliding leaf; or service door frame. Any above steel plate or steel sheet may extend to an outer edge or to within a section width or subsection width of the modular frame; to the sliding leaf; or service door frame; or one or more component of the modular frame; the sliding leaf; or service door frame.

Any one or more component of the secure sliding closure of any one of the above aspects may comprise steel. Any one or more component of the secure sliding closure may comprise rectangular hollow section (RHS) steel. Each component may comprise four faces. Any one or more component of the secure sliding closure may comprise heavy gauge 150 steel. These components of the secure sliding closure comprise the components of the modular frame being the main frame; the door frame; the subframe; and the service door frame; and the components of the sliding door frame. The components of the main frame comprise: the frame upright; the portal upright; the top plate; the bottom plate; the frame upright head mounting member; the portal upright head mounting member; the frame upright floor mounting members; the portal upright floor mounting members. The components of the door frame comprise: the locking side upright; the secure cavity upright; and the door frame top plate. The components of the subframe comprise: the horizontal members; and the vertical members. The components of the service door frame comprise: the service door uprights; the service door top plate; and the service door bottom plate. The components of the sliding leaf frame comprise; the sliding leaf uprights; and the sliding leaf crossmember.

Any two or more components of the modular frame and/or the sliding leaf frame according to any one of the above aspects may be welded and/or bolted together. The components of the modular frame and/or the sliding leaf frame may abut each other when assembled. A sub-set of the components may be assembled before installation.

Any one or more components of the modular frame and/or sliding leaf frame according to any one of the above aspects may be linear or substantially linear.

Any two or more components of the modular frame and/or sliding leaf frame according to any one of the above aspects may be co-planar or substantially co-planar when assembled as part of the modular frame. The co-planar arrangement may mean all faces of all components are co-planar or substantially co-planar with all respective faces.

In another embodiment of any one of the above aspects, one or more of the frame upright; portal upright; locking side upright; secure cavity upright; vertical members; service door uprights; sliding leaf upright may be vertical or substantially vertical when assembled as part of the closure.

In yet another embodiment of any one of the above aspects, the one or more of the top plate; bottom plate; door frame top plate; horizontal members; service door top plate; service door bottom plate; and sliding leaf crossmember may be horizontal or substantially horizontal when assembled as part of the closure.

In still another embodiment of any one of the above aspects, the secure side may further comprise one or more safety sensor. The one or more safety sensor may stop leaf motion when an object or person is detected in an area of travel of the leaf. The one or more safety sensor may be disposed on the secure cavity upright. Each of the one or more safety sensor may comprise a Dorma safety sensor.

According to any one of the above aspects, the attack side of the modular frame and/or sliding leaf may comprise angle beading. The attack side may further comprise staggered welding between fasteners.

According to any one of the above aspects said modular frame and/or sliding leaf core may be filled. The filling may comprise one or more of a safety material or additional functional material. The safety material may comprise a fire rated material. The additional functional material may comprise an acoustic rated material.

According to any one of the above aspects, the closure may further comprise one or more seal such as a door stop seal and a smoke and acoustic seal. The door stop seal may comprise a door stop seal for one or more of: noise; light and smoke. A suitable door stop seal is RP24 available from Raven Products. The smoke and acoustic seal may contain sound and restrict the spread of smoke or other gases. A suitable smoke and acoustic seal is the LAS 1212 Batwing acoustic smoke seal from Lorient.

According to any of the above aspects, a power and/or network connection may be further comprised. The power and/or network connection may operatively communicate with a remote location.

According to any one of the above aspects, the remote location may be in the same building and/or a different building.

In yet another embodiment according to any one of the above aspects, the secure sliding closure may comprise one or more tamper alarm.

Further aspects and/or features of the present invention will become apparent from the following detailed description.

BRIEF DESCRIPTION OF THE FIGURES

In order that the invention may be readily understood and put into practical effect, reference will now be made to embodiments of the present invention with reference to the accompanying drawings, wherein like reference numbers refer to identical elements. The drawings are provided by way of example only, wherein:

FIG. 1A: is a schematic diagram showing a front view of an secure side of one embodiment of a secure sliding closure according to the invention.

FIG. 1B: is a schematic diagram showing a front view of an attack side of one embodiment of a secure sliding closure according to the invention.

FIG. 2C: is a schematic diagram showing detail A labelled in FIG. 2A.

FIG. 3A: is another schematic diagram showing a front view of an attack side of one embodiment of a secure sliding closure according to the invention.

FIGS. 5A(i) and 5A(ii): are schematic diagrams showing the inserts of a sliding leaf according to a first embodiment of the invention in an assembled view (i) and an exploded view (ii).

FIGS. 5B(i) and 5B(ii): are schematic diagrams showing the inserts of a sliding leaf according to a second embodiment of the invention in an assembled view (i) and an exploded view (ii).

FIGS. 5C(i) and 5C(ii): are schematic diagrams showing the inserts of a sliding leaf according to a third embodiment of the invention in an assembled view (i) and a detail view (ii) showing region "N" encircled in FIG. 5C(i).

FIGS. 5D(i) and 5D(ii): are schematic diagrams showing the inserts of a sliding leaf according to a fourth embodiment of the invention in an assembled view (i) and a detail view (ii) showing region "0" encircled in FIG. 5D(i).

FIGS. 5E(i) and 5E(ii): are schematic diagrams showing the inserts of a sliding leaf according to a fifth embodiment of the invention in an assembled view (i) and an exploded view (ii).

FIG. 6A shows a front view of the double doors in a closed arrangement and FIG. 6B shows a front perspective view of the double doors in an open arrangement.

Figure 2A:
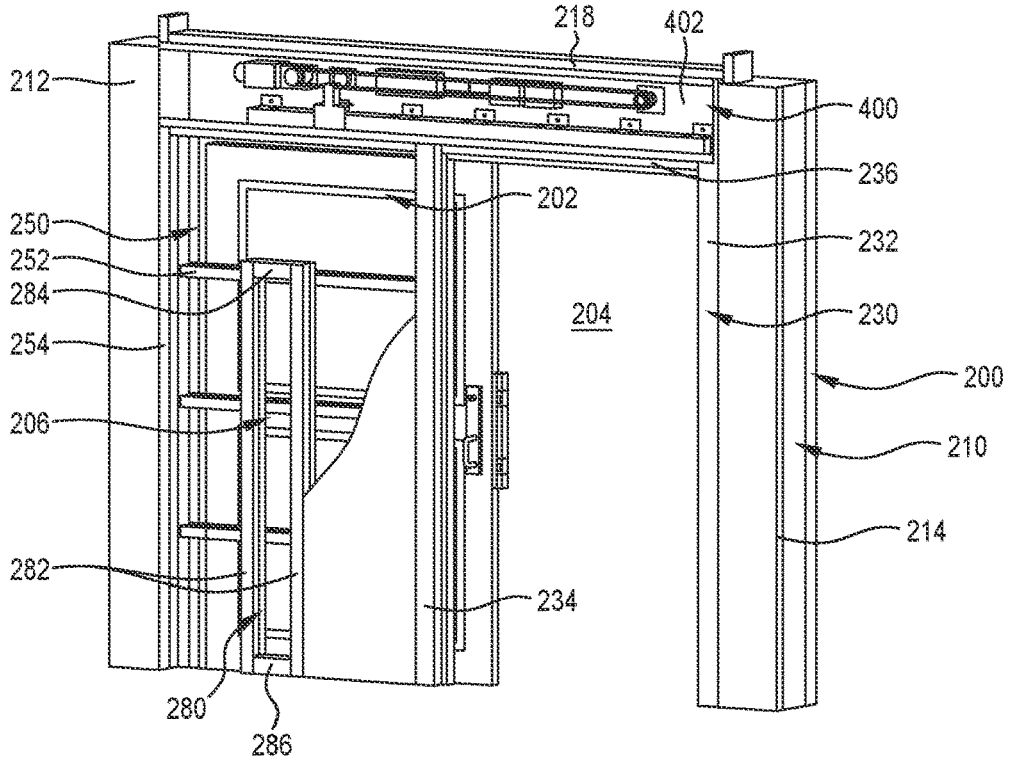
FIG. 2A: is a schematic diagram showing a partial cut away, front view of a secure side of one embodiment of a secure sliding closure according to the invention.

Skilled addressees will appreciate that elements in the drawings are illustrated for simplicity and clarity and have not necessarily been drawn to scale. For example, the relative dimensions of some elements in the drawings may be distorted to help improve understanding of embodiments of the present invention.

DETAILED DESCRIPTION

Embodiments of the present invention relate to secure sliding closure comprising a modular frame. More particularly, this invention relates to a secure sliding closure comprising a modular frame defining a secure cavity and a portal and one or more sliding leaf comprising a secure leaf frame and one or more security panel.

The present invention is particularly advantageous when applied to rooms where important, valuable, and confidential information is exchanged, transmitted, received or stored. The ability to provide a secure sliding closure means available space is not compromised by having to swing a door leaf open and closed, instead the leaf retracts into the wall cavity.

For purposes of description herein, the terms "upper," "lower," "right," "left," "rear," "front," "vertical," "horizontal," "interior," "exterior," and derivatives thereof shall relate to the invention as oriented in FIG. 1A. However, it is to be understood that the invention may assume various alternative orientations, except where expressly specified to the contrary.

FIGS. 1A; 1B; 2A; 2B; 2C; 3A; 3B; 3C; 3D; 3E; 3F; 3G; and 3H show one embodiment of a secure sliding closure 100 according to the invention. Secure sliding closure comprises modular frame 200 defining at least one secure cavity 202 and a portal 204. Modular frame 200 then comprises a main frame 210 and at least one door frame 230.

Main frame 210 comprises at least one frame upright 212 spaced apart from at least one portal upright 214 and a respective at least one top plate 218 extending therebetween. Both the frame upright 212 and the portal upright 214 as shown comprise a stud 212*a*, 214*a*, in the form of a heavy gauge steel stud, and a support post 212*b*, 214*b* (only 214*a* and 214*b* are shown in the Figures, see FIG. 3E).

The at least one door frame 230 comprises a locking side upright 232 spaced apart from a secure cavity upright 234 and a door frame top plate 236 extending therebetween.

The arrangement of main frame 210 and at least one door frame 230 is such that the modular frame 100 defines at least one secure cavity 202 between respective at least one frame upright 212 and secure cavity upright 234 and defines a portal 204 between respective secure cavity upright 234 and locking side upright 232.

The above-referenced Figures also show secure sliding closure 100 to comprise one or more sliding door 300 which comprises sliding leaf 302 and a sliding leaf covering 340 that is disposed on sliding leaf 300. Sliding leaf 302 is positioned for sliding from within the secure cavity 202 to across the portal 204, to prevent access through portal 204. To aid in providing secure access, that is to prevent unauthorised access by destruction of leaf 302, covering 340 comprises one or more sliding door security panel 342.

Figure 3B:
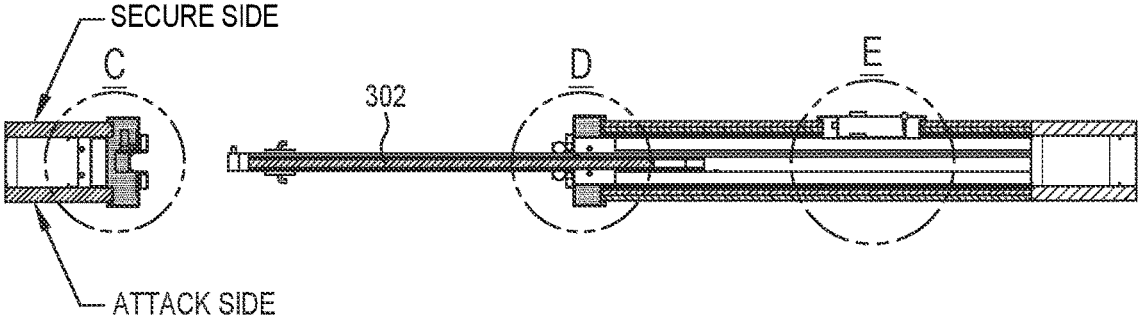
FIG. 3B: is a schematic diagram showing cross-section A-A labelled in FIG. 3A.
Figure 3C:
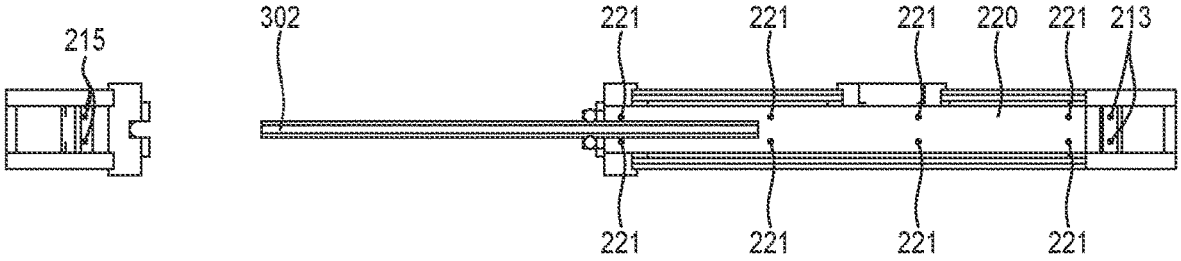
FIG. 3C: is a schematic diagram showing cross-section B-B labelled in FIG. 3A.
Figure 3D:
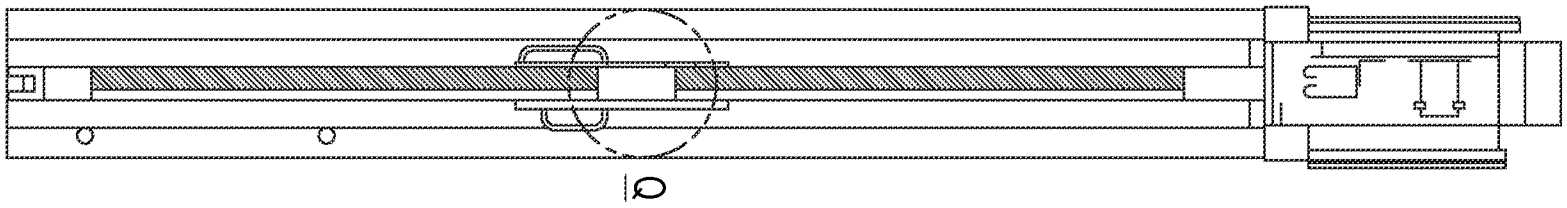
FIG. 3D: is a schematic diagram showing cross-section P-P labelled in FIG. 3A.
Figure 3E:
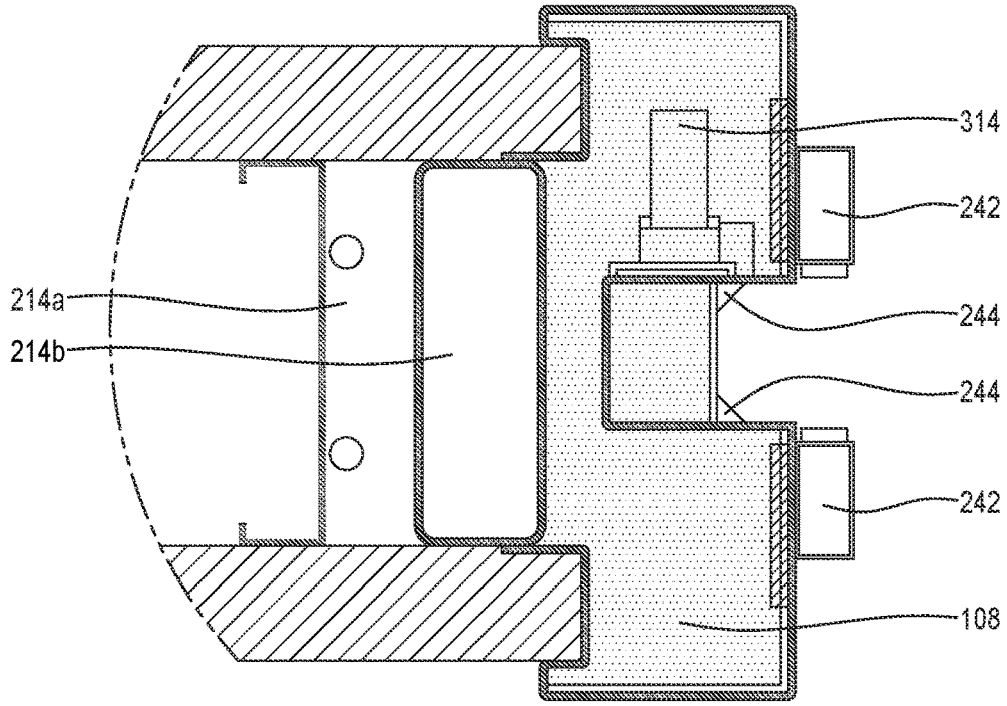
FIG. 3E: is a schematic diagram showing detail C labelled in FIG. 3B.
Figure 3F:
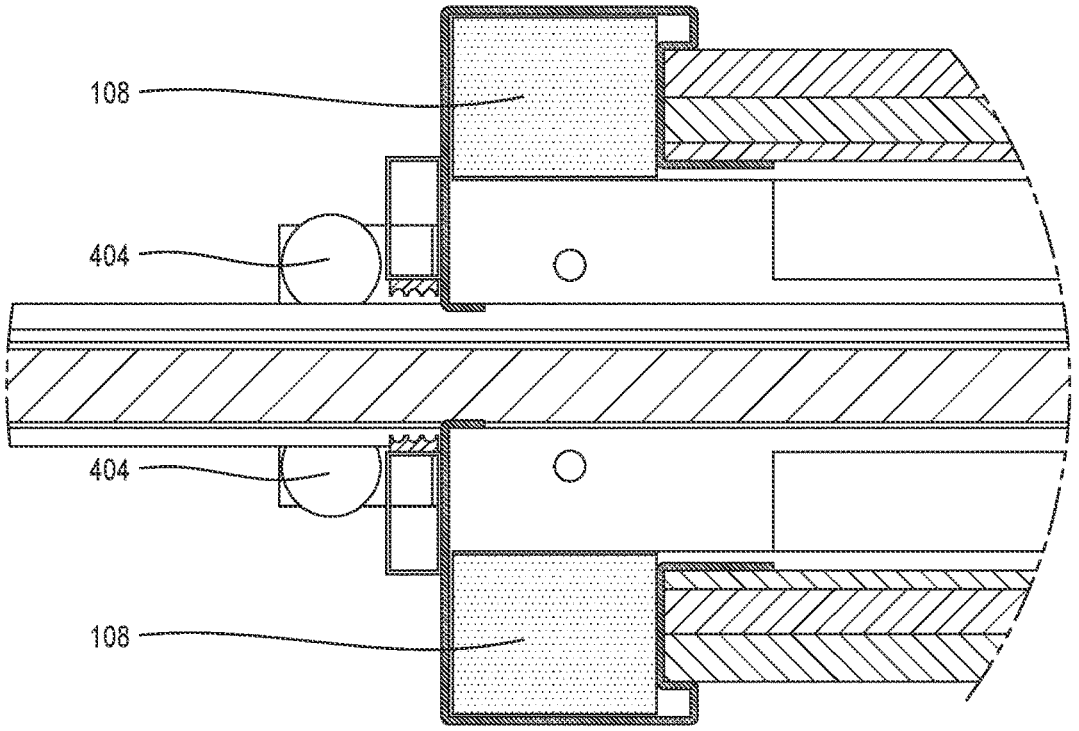
FIG. 3F: is a schematic diagram showing detail D labelled in FIG. 3B.

As shown in FIG. 3C, main frame 200 further comprises bottom plate 220 extending between the frame upright 212 and the secure cavity upright 202, or in another embodiment, between the frame upright 212 and the portal upright 214. The bottom plate 220 is shown to be fastened to the floor, with bottom plate fasteners 221 which comprise floor fixings in the form of cavity pocket stagger bolts. The bottom plate fasteners may comprise 1; 2; 3; 4; 5; 6; 7; 8; 9; 10; 11; 12; 15; or 20 cavity pocket stagger bolts. In the embodiment shown in the above-referenced Figures, 8 bottom plate fasteners are comprised.

Main frame 210 is also shown to further comprise mounting members 222, 224, 226, 228 mounted to the floor or the soffit. FIG. 2A shows a frame upright head mounting member 222 and a portal upright head mounting member 224. Although not shown, frame upright floor mounting member (s) 226 and portal upright floor mounting member(s) 228 may also be comprised. In the embodiment of FIGS. 1; 2; and 3; mounting members 222, 224, 226, 228 may comprise dimensions of 150×50 mm. Each of the one or more mounting member 222, 224, 226, 228 is mounted to the frame upright 212 and/or the top plate 218; the portal upright 214 and/or the top plate 218; the frame upright 212 and/or the bottom plate 220; or the portal upright 214 and/or the bottom plate 220, as required for assembly. From the teaching herein, a skilled person is readily able to select suitable fasteners for securing the one or more mounting member to the floor or soffit.

Main frame 210 may further be fastened to the floor with one or more main frame floor fastener 213, 215 such as, one or more frame upright floor fastener 213 and one or more portal upright floor fastener 215. The main frame floor fasteners 213, 215 may comprise floor fixings such as cavity pocket stagger bolts. In the embodiment shown in FIGS. 1; 2 and 3; two frame upright floor fasteners 213 and two portal upright floor fasteners 215 are comprised. In other embodiments, main frame floor fasteners 213, 215 may comprise 1; 2; 3; 4; 5; 6; 7; 8; 9; 10; 11; 12; 15; or 20 cavity pocket stagger bolts.

As labelled in FIGS. 1; 2 and 3 modular frame 200 comprises an attack side and a secure side. The main frame secure side comprises a service door portal 206 which is defined by service door frame 280. Service door frame 280 comprises spaced apart service door uprights 282, a service door top plate 284 and service door bottom plate 286.

Each of the modular frame attack side and the modular frame secure side may further comprise one or more modular frame security panel 209 covering or partially covering the secure cavity 202 and/or any other part of the secure sliding closure 100.

Figure 2B:
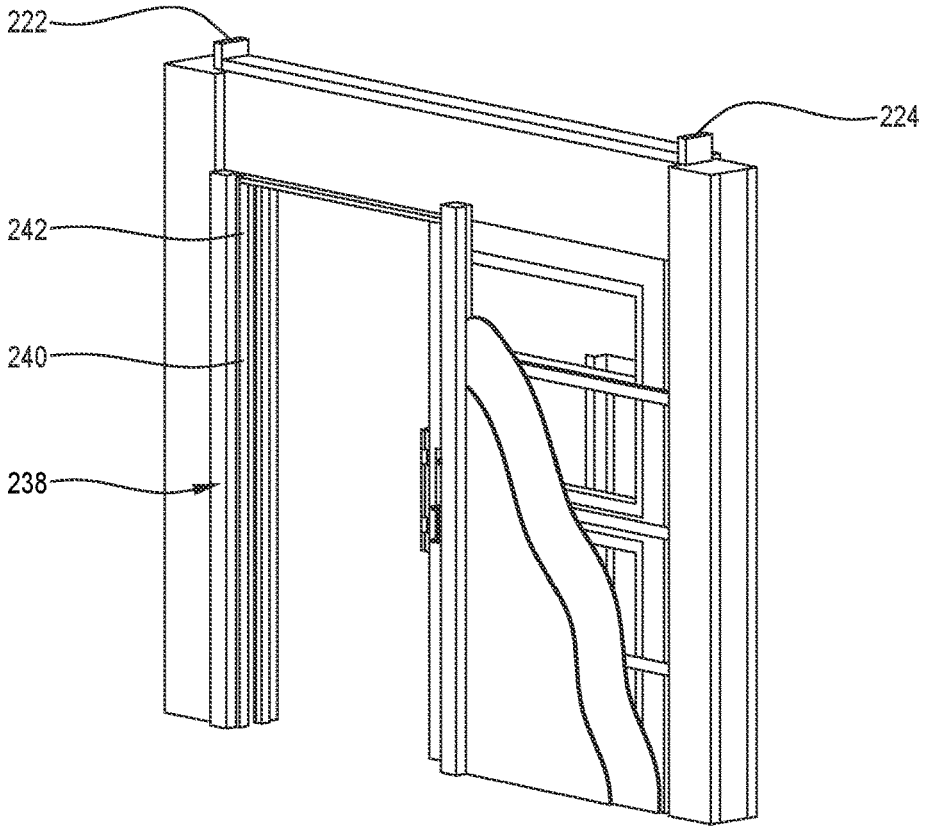
FIG. 2B: is a schematic diagram showing a partial cut away, front view of an attack side of one embodiment of a secure sliding closure according to the invention.

As shown in FIGS. 2A and 2B, main frame 210 may further comprise a subframe 250 which comprises horizontal members 252 and vertical members 254. Subframe 250 at least partially encloses secure cavity 202. As will be understood by a skilled person from the teaching herein, subframe 250 may provide addition rigidity to frame 200.

Main frame 210 also comprises service door leaf 288 which comprises a solid door leaf in the form of a SAPD-SD-MO leaf which comprises a 50 mm core. In various embodiments, service door leaf 288 comprises a 30; 40; 50; 60; 70; or 80 mm core. Service door leaf 288 is attached to service door frame 280 with service door hinges 281 in the form of ball bearing hinges.

Figure 3G:
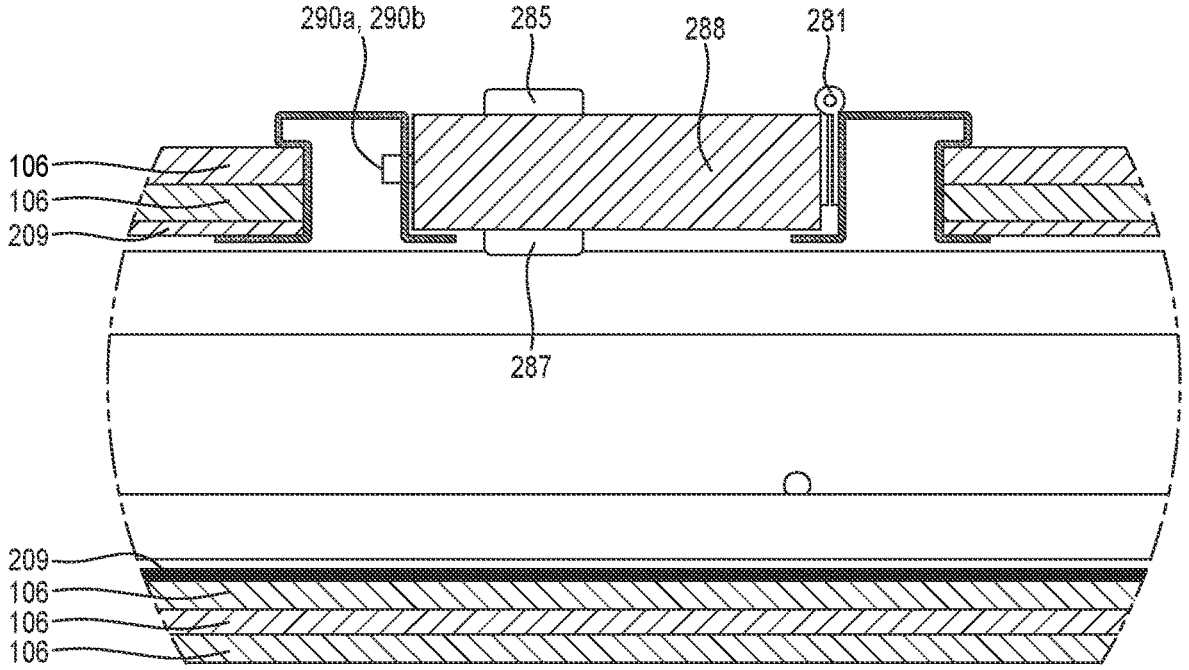
FIG. 3G: is a schematic diagram showing detail E labelled in FIG. 3B.
Figure 3H:
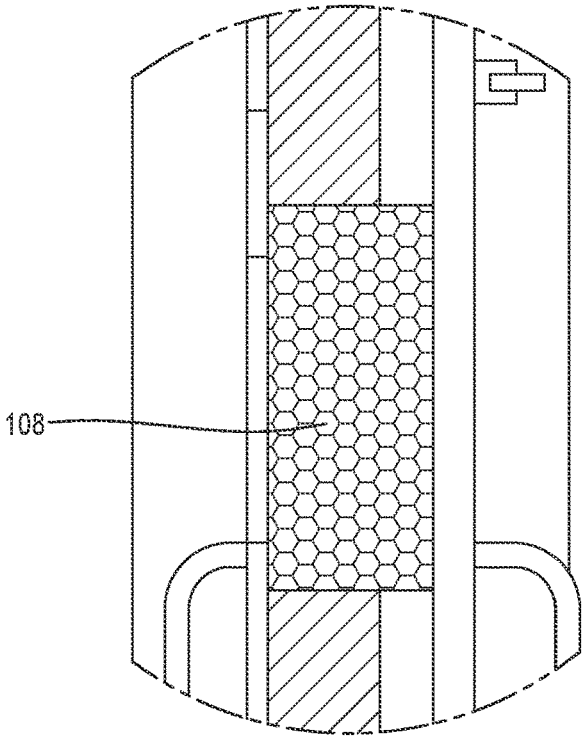
FIG. 3H: is a schematic diagram showing detail Q labelled in FIG. 3D.

Service door leaf 288 is shown to further comprise other conventional components of a door or door leaf, namely service door locks 290 in the form of upper dead lock 290*a* and lower dead lock 290*b*; service door furniture 285 and one or more service door endplate 287 (see FIG. 3G). Like sliding door 200, service door leaf 288 comprises one or more service door security panel 289.

Modular frame 200 houses one or more frame mortice lock 102, which may be disposed above and/or below the sliding leaf 302. In the embodiment shown in FIGS. 1 to 3, the one or more frame mortice lock 102 comprise two frame mortice locks 102, a first frame mortice lock 102 disposed at a frame upright end and a second frame mortice lock 102 disposed at a portal upright end. In the embodiment shown, each of frame mortice locks 102 comprise a Sliding Door Mortice Lock.

As can be seen from FIG. 1A, sliding door 300 comprises one or more sliding door lock body cavity 304 housing a sliding door lock body 310. The lock body 310 comprises one or more sliding door locks 312 which engage with a door frame strikeplate 238 disposed on the locking side upright 232. In the embodiment shown, the one or more sliding door locks 312 comprise a sliding door mortice lock in a lower position and a sliding door dead lock in an upper position, that is the dead lock is above the mortice lock. When two or more sliding door locks 312 are present, they may be activated in concert with a multi lock release mechanism such as that described in Australian Patent Application Number 2018247281. In the embodiment shown, the multi lock release mechanism comprises a BM-SSDL2 from Bridgewater Multidoors. Each of the one or more sliding door locks 312 may be locked and unlocked by an electric switch 314 such as, a microswitch. The electric switch may be connected to a network and operated from a remote location. The sliding door 300 may comprise one; two; three; four; five; six; seven; eight; or eight or more locks 312.

As shown in FIG. 2B door frame strikeplate 238 comprises an adjustable strike insert 240, in the form of a MLMF 22 available from Bridgewater Multidoors. Strikeplate 238 is an electronic strike.

The secure access and resistance to attack provided by secure sliding closure 100, is in part due to each of the sliding door security panel 342, service door security panel 289 and modular frame security panel 209 comprising one or more steel plate or steel sheet or one or more transparent or partially transparent sheet.

Advantageously, the one or more transparent or partially transparent layer may allow a view of the other side. The transparent or partially transparent layer may comprise transparent armour comprising a strong and optically transparent material that is resistant to penetration by projectiles. The transparent armour may comprise a material such as, one or more layer of toughened laminate and/or one or more layer of laminated polycarbonate. The one or more layer of toughened laminate may comprise one or more layer of toughened laminated glass. The one or more layer of laminated polycarbonate may comprise one or more layer of ballistic grade sheet.

In addition to the steel plate(s) or steel sheet(s) each of the one or more sliding door security panel 342 may further comprise one or more safety layer; one or more additional functional layer; one or more insert layer; and or one or more structural layer. The safety layer may comprise a fire rated material, whilst the additional functional layer may comprise an acoustic rated material. The one or more structural layer may comprise a wood; engineered wood; or polymeric layer such as, a Laminated Veneer Lumbar (LVL) layer. The one or more insert may further comprise a louvre layer such as, a steel louver. Various exemplary embodiments for sliding door security panel 342 are shown in FIGS. 5A(i) and 5A(ii) two steel plates sandwiching a LVL layer; 5B(i) and 5B(ii) a layer of toughened laminate; 5C(i) and 5C(ii) a layer of ballistic grade sheet; 5D(i) and 5D(ii) two layers of steel mesh sandwiching a layer of steel louver; and 5E(i) and 5E(ii) two 6 mm steel plates sandwiching a layer of fire rated panel.

Figure 4A:
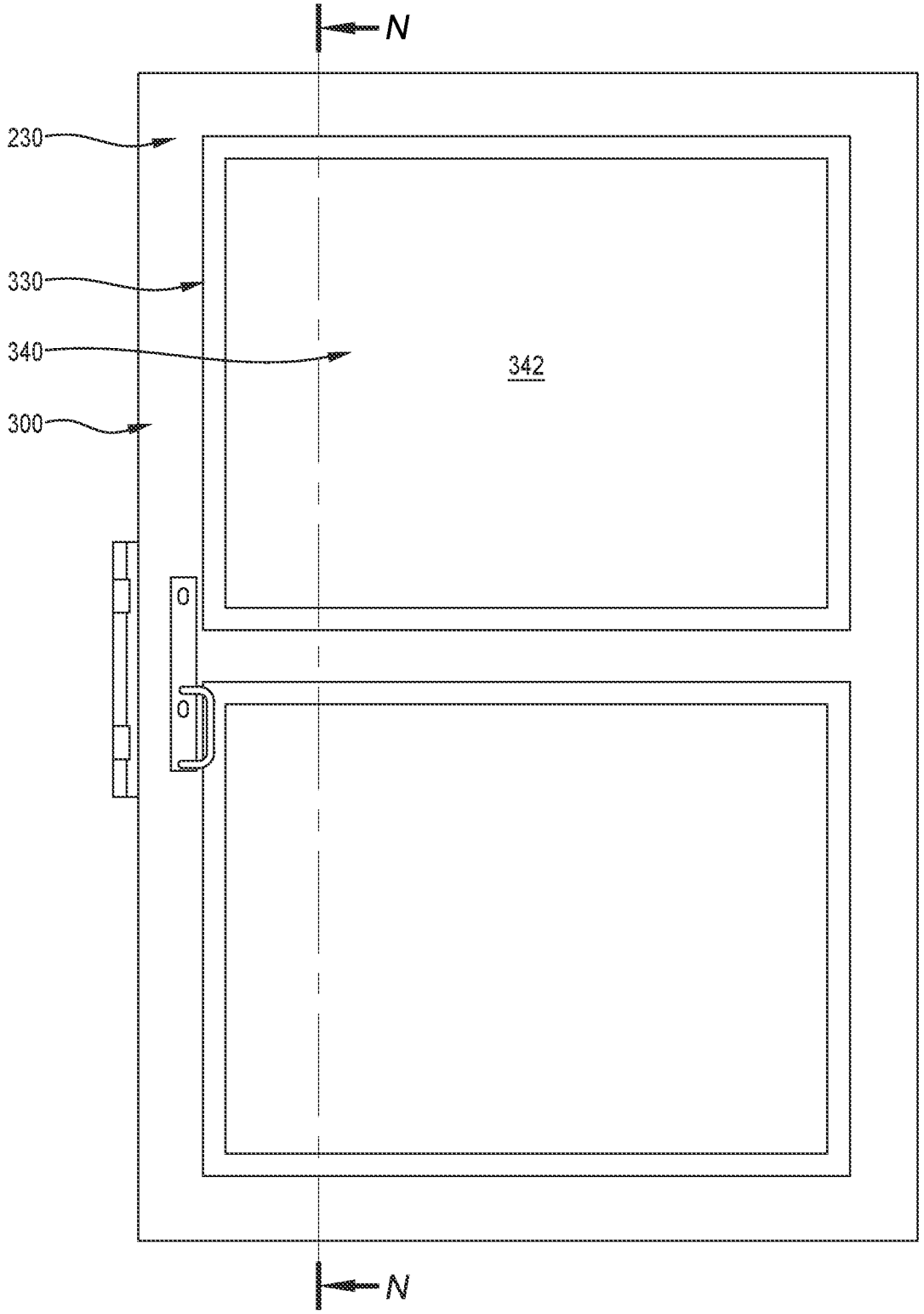
FIG. 4A: is a schematic diagram showing an attack side of a sliding door according to one embodiment of the invention.
Figure 4B:
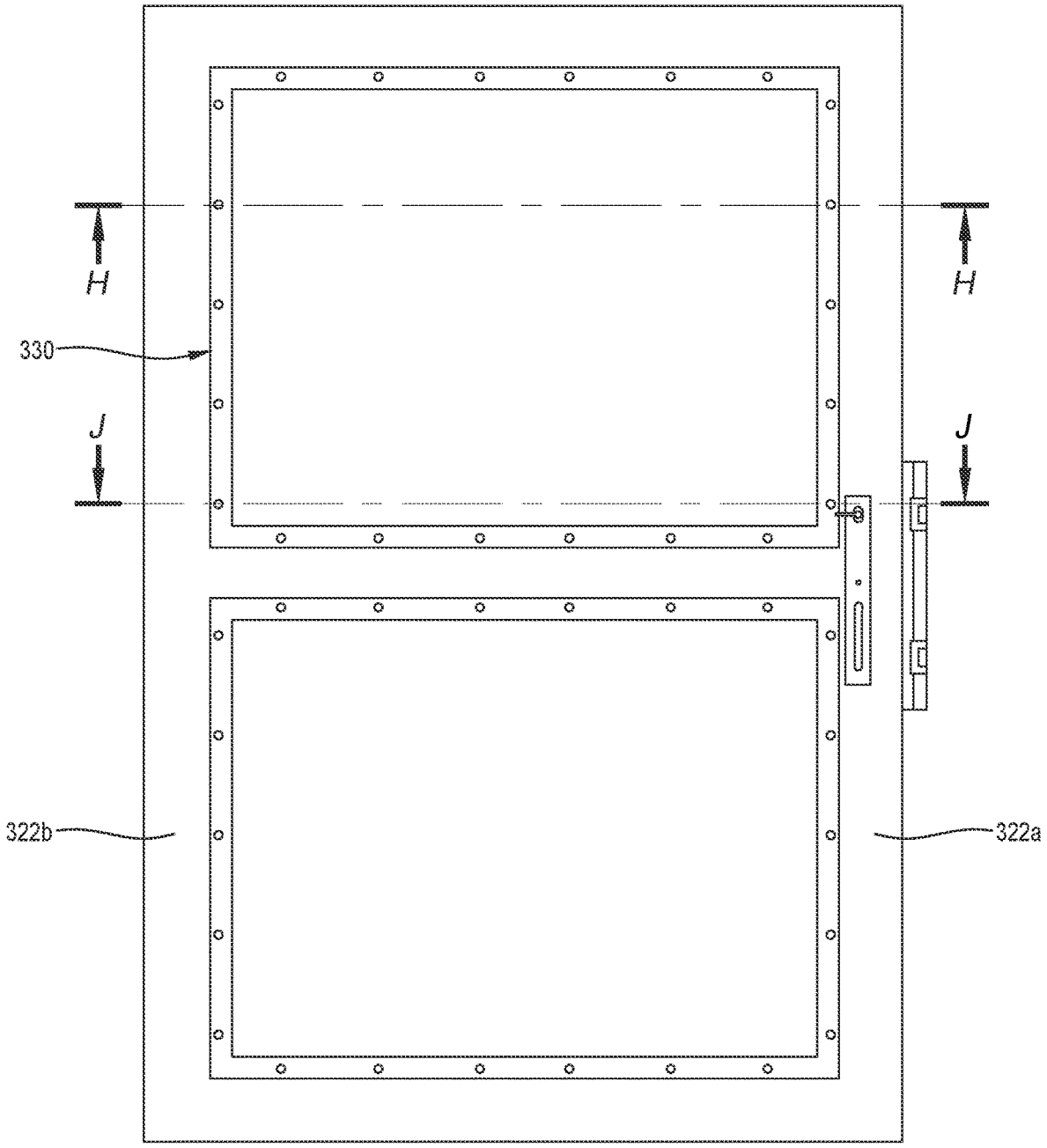
FIG. 4B: is a schematic diagram showing a secure side of a sliding door according to one embodiment of the invention.
Figure 4C:
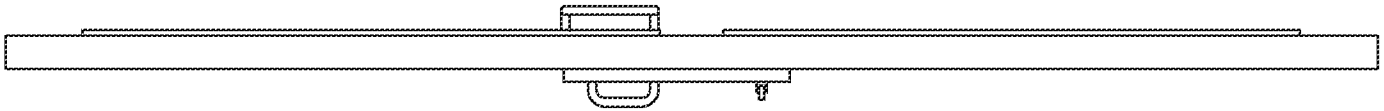
FIG. 4C: is a schematic diagram showing an end view of a sliding door according to one embodiment of the invention.
Figure 4D:
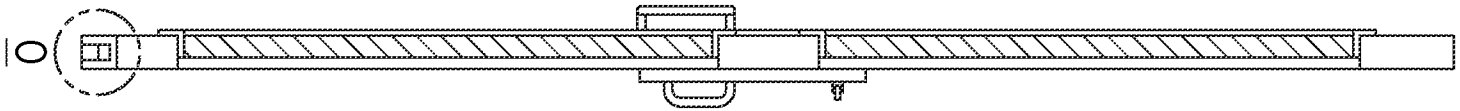
FIG. 4D: is a sectional view through section N-N labelled in FIG. 4A.

Each of the one or more sliding door security panel 342 may be fastened to the sliding door 300 with a suitable fastener on the secure side such as, one or more bolts. The one or more secure side fastener 344 (not shown) may extend through or into one of the one sliding door security panels 342. Secure side fastener 344 may comprise a fastener anchor 346 such as, a threaded tube as shown in FIG. 4G. The one or more secure side fastener 344 may be fastened to a secure flat bar frame 330 housing the one or more sliding door security panel 342. The one or more secure side fasteners 344 may be on an outer edge of the sliding door 300

Each of the one or more sliding door security panel 342 may be fastened to the sliding door 300 with a suitable fastener 348 on the attack side such as, one or more bolts. The one or more attack side fastener 348 may extend through or into one of the one or sliding door security panel 342 and may be fastened to the secure flat bar frame 330. The one or more attack side fastener 348 may be on an inside edge of the sliding door 300. FIG. 4I shows both drilled and tapped holes to accommodate fasteners 348 and drilled holes to accommodate plug welds. The fasteners 348 and welds are alternated along the length of flat bar frame 330. This ensures maximum strength of the sliding leaf covering 340 and sliding door security panel 342.

Figure 4E:
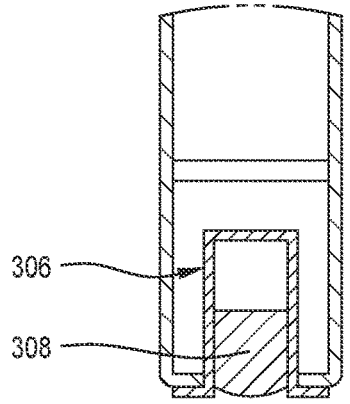
FIG. 4E: is a schematic diagram showing detail O labelled in FIG. 4D.
Figure 4F:
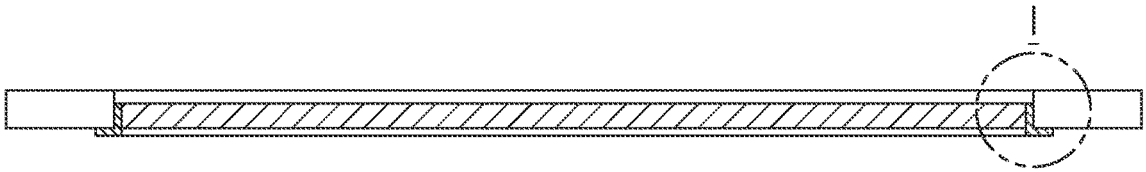
FIG. 4F: is a sectional view through section H-H labelled in FIG. 4B.
Figure 4G:
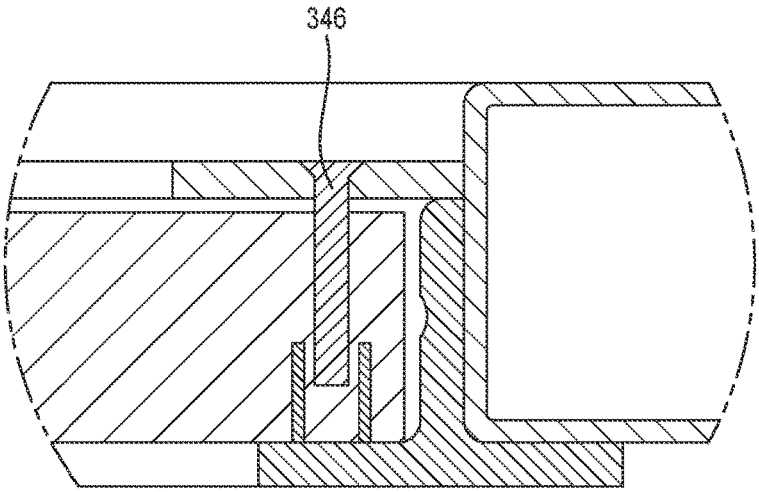
FIG. 4G: is a schematic diagram showing detail I labelled in FIG. 4F.
Figure 4H:
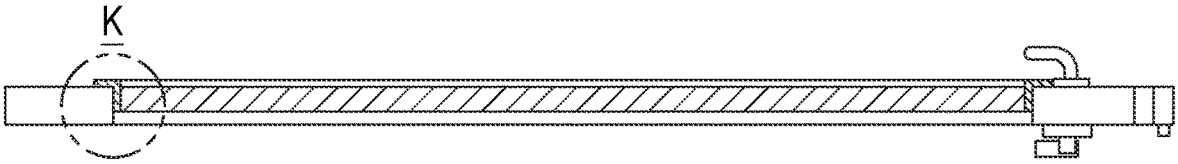
FIG. 4H: is a sectional view through section J-J labelled in FIG. 4B.
Figure 4I:
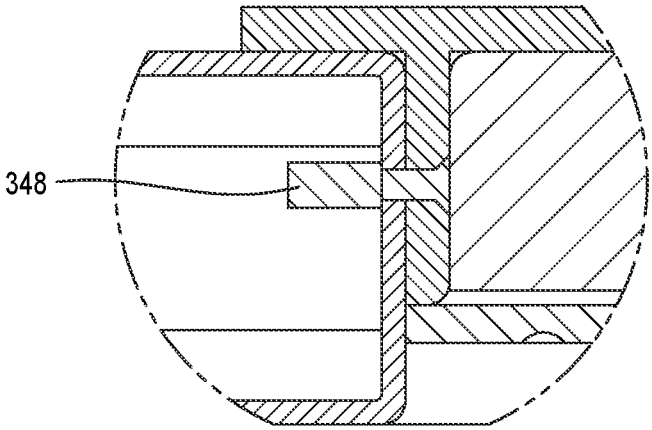
FIG. 4I: is a schematic diagram showing detail K labelled in FIG. 4F.
Figure 4J:
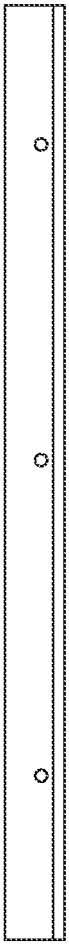
FIG. 4J: is a schematic diagram showing a detail view of the flat bar frame shown in FIG. 4B with the attack side on the left.

As shown in FIG. 4E, sliding door 300 may further comprise one or more sliding door frame lock 306 which comprises a sliding door frame lock bolt 308 for extension into a floor cavity. In the embodiment shown, sliding door frame lock 306 is a LAS 8007si lock disposed at, on or near sliding leaf cavity upright 322*a*. Based on the teaching herein, a skilled person is readily able to select other locks and suitable locations for sliding door frame lock 306.

As with conventional sliding doors, sliding closure 100 comprises a sliding door track 400 which is comprised in a sliding door track housing 402 and is covered with sliding door cover 406. The sliding door track 400 is fastened to the modular frame 200 and comprises one or more hangers for attachment of sliding leaf 302. The sliding door track 400 and sliding door track housing 402 are shown disposed at a top of the secure sliding closure 100.

As shown in FIG. 2C secure sliding closure 100 further comprises roller guides 404 at a bottom of the modular frame 200. In the embodiment shown in FIGS. 1; 2 and 3 one roller guide 404 is disposed on each side of leaf 302. As with conventional guides, roller guides 404 are typically disposed at a bottom of the modular frame.

Sliding door 300 may further comprise an automatic door operator, which may be fixed to the modular frame 200, to open and close the sliding leaf 302. In the embodiment shown in FIGS. 1; 2; and 3 a Dorma AL501 SA2 automatic door operator is utilised. The automatic door operator may be connected to a network for remote operation. Advantageously, the automatic door operator may be operatively connected to a card or key reader for opening and/or closing and/or to a secure lock actuator for secure locking.

As described for modular frame 200, sliding leaf 302 comprises an attack side and a secure side. Each of the attack side and the secure side may comprise a sliding door security panel 342.

As shown in FIG. 1A sliding leaf 302 comprises a sliding leaf frame 320 comprising sliding leaf frame uprights 322 (sliding leaf cavity upright 322*a* and sliding leaf portal upright 322*b* see FIG. 4A) and one or more sliding leaf crossmembers 324.

FIGS. 4A; 4B; 4C; 4D; 4E; 4F; 4G; 4H; 4I; 4J are schematic diagrams of one embodiment of a sliding door 300 according to the invention. Sliding door 300 is shown in these figures to comprise a flat bar frame 330 which frames the one or more security panel 342 comprised in the particular leaf design implemented for a chosen secure location. For example, if it is not required to see through to the other side, there is no requirement for sliding door security panel 342 to be transparent.

Whilst the secure sliding closure 100 provides a high degree of security, by overlaying or partially overlaying the one or more security panel 209, 289, 342 (modular frame security panel 209; service door security panel 289; sliding door security panel 342) or frame 200, 210, 230, 280, and 320 (modular frame 200; main frame 210; door frame 230; service door frame 280; and sliding leaf frame 320) with a decorative covering, an aesthetically pleasing appearance may be achieved and/or the secure nature of closure 100 may be camouflages. The decorative covering may comprise one or more plasterboard layers 106 and/or one or more sheet of ply. The one or more plasterboard layers may comprise an outermost covering of the cavity 202, on one or both of the secure side and attack side. The decorative covering may further comprise a removable pelmet.

Any above steel plate or steel sheet or ply sheet may comprise a thickness of 1; 2; 3; 4; 5; 6; 7; 8; 9; 10; 11; 12; 13; 14; 15; 20 or 25 mm. The closure 100 and leaf 300 shown in the above-reference figures utilise 8 mm steel plate or steel sheets and 9 mm ply sheets. Any one of the steel plates or steel sheets or ply sheets may be welded and/or bolted onto the modular frame 200; main frame 210; door frame 230; service door frame 280; and/or sliding leaf frame 320; or one or more component thereof.

Any above security panel 209, 289, 342 or decorative covering may overlay the modular frame 200; sliding leaf 302; or service door frame 280; or one or more component thereof or may extend to an outer edge or to within a section width or subsection width of thereof or of one or more component thereof.

From the teaching herein, the skilled person will understand that one or more component of the secure sliding closure 100 may comprise steel. Any one or more component of the secure sliding closure 100 may be comprises of rectangular hollow section (RHS) steel. As is typical of RHS steel components, each component may comprise four faces. Any one or more component of the secure sliding closure 100 may be comprised of heavy gauge 150 steel. These components of the secure sliding closure 100 comprise the components of the modular frame 120 being the main frame 210; the door frame 230; the subframe 250; and the service door frame 280; and the components of the sliding leaf frame 320. The components of the main frame 210 comprise: the frame upright 212 (including the frame upright stud 212*a* and the frame upright support post 212*b*); the portal upright 214 (including the portal upright stud 212*a* and the portal upright support post 214*b*); the top plate 218; the bottom plate 220; the frame upright head mounting member 222; the portal upright head mounting member 224; the frame upright floor mounting members 226; and the portal upright floor mounting members 228. The components of the door frame 230 comprise: the locking side upright 232; the secure cavity upright 234; and the door frame top plate 236. The components of the subframe 250 comprise: the horizontal members 252; and the vertical members 254. The components of the service door frame 280 comprise: the service door uprights 282; the service door top plate 284; and the service door bottom plate 286. The components of the sliding leaf frame 320 comprise; the sliding leaf uprights 322; and the sliding leaf crossmember 324.

Any two or more of these components of the modular frame 200 and/or the sliding leaf frame 320 may be welded and/or bolted together. These components may abut each other when assembled. As will be readily appreciated by the skilled person from the teaching herein, a sub-set of the components may be assembled before installation.

As can be seen from the embodiment shown in the above-reference figures, these components may be linear or substantially linear and co-planar or substantially co-planar when assembled as part of modular frame 200. This co-planar arrangement means all faces of all components are co-planar or substantially co-planar with all respective faces.

From the embodiment shown in above-reference figures, it can also be seen one or more of the frame upright 212; portal upright 214; locking side upright 232; secure cavity upright 234; vertical members 254; service door uprights 282; and sliding leaf upright 322 may be vertical or substantially vertical when assembled as part of the closure 100.

It is also apparent from the embodiment shown in the above referenced figures that one or more of the top plate 218; bottom plate 220; door frame top plate 236; vertical members 254; service door top plate 284; service door bottom plate 286; and sliding leaf crossmember 324 may be vertical or substantially vertical when assembled as part of closure.

When fitted in a secure location, it is convenient to fit to the secure side one or more safety sensor which may stop leaf 302 motion when an object or person is detected in an area of travel of the leaf 302. A suitable location for the one or more safety sensor is the secure cavity upright 234. From the teaching herein, a skilled person is readily able to select a suitable safety sensor such as, the Dorma safety sensor.

To increase rigidity and resist attack, the attack side of the modular frame 200 and/or sliding leaf 302 may comprise angle beading. The attack side may further comprise staggered welding between fasteners.

The core of modular frame 200 and sliding leaf 302 core may be filled. Suitable filling materials 108 include a safety material or additional functional material. The safety material may comprise a fire rated material, whereas the additional functional material may comprise an acoustic rated material.

As shown in FIG. 2B, closure 100 further comprises a door stop seal 242 and a smoke and acoustic seal 244. The door stop seal 242 comprises a seal for one or more of noise; light and smoke. A suitable door stop seal is RP24 available from Raven Products. The smoke and acoustic seal 244 may contain sound and restrict the spread of smoke or other gases. A suitable smoke and acoustic seal 244 is the LAS 1212 Batwing acoustic smoke seal from Lorient.

Although not shown in the Figures, a power and/or network connection may be comprised for communicate with a remote location. This remote location may be in the same building and/or a different building.

Another feature not shown in the Figures, is a tamper alarm. Nevertheless, closure 100 may also comprise one or more tamper alarm.

Figure 6A:
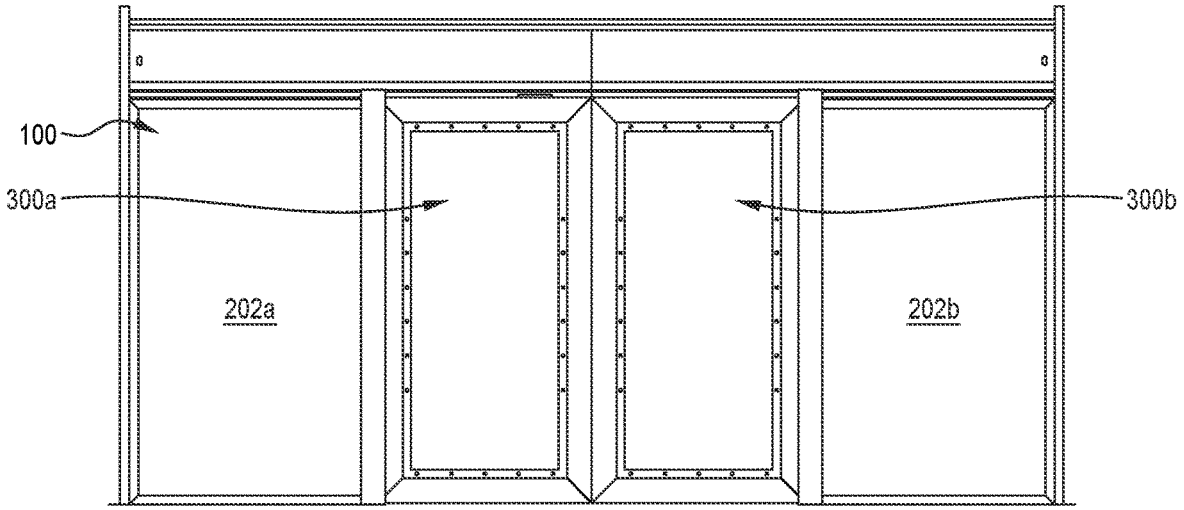
FIGS. 6A and 6B: are schematic diagrams showing a double sliding door according to one embodiment of the invention.
Figure 6B:
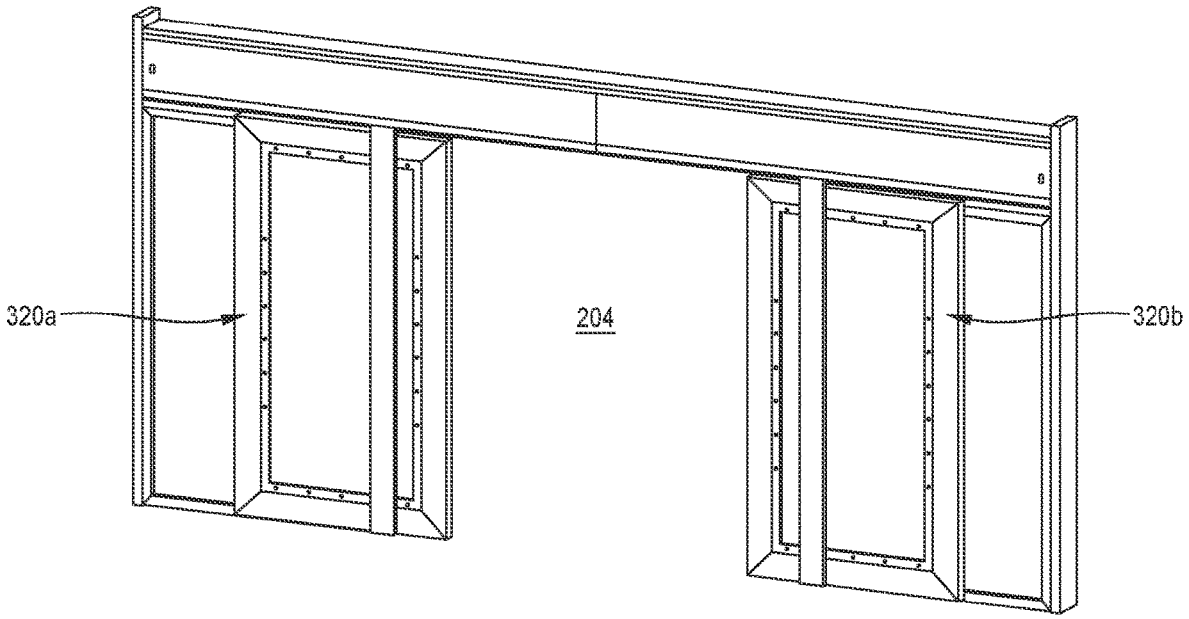

FIGS. 6A and 6B show the closure 100 implemented as double sliding doors 300*a*, 300*b*, with left and right secure cavities 202*a*, 202*b* and a central portal 204, the modular frame 200 comprising respective left and right main frames 202*a*, 202*b* and left and right sliding leaf frames 320*a*, 320*b*.

Figure 7A:
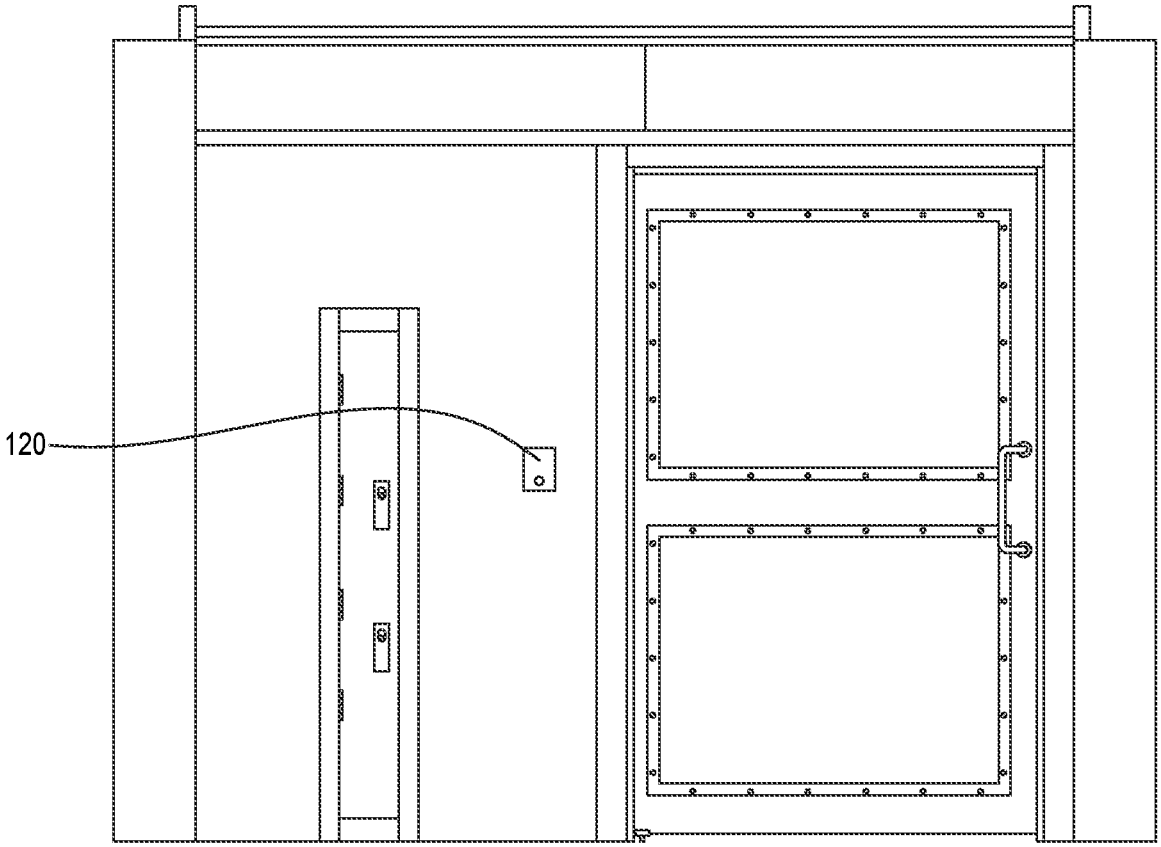
FIGS. 7A; 7B; and 7C: are schematic diagrams of one embodiment of the secure sliding door of the invention implemented in a vault showing a secure side (7A); attack side with swing doors closed (7B); and attack side with swing doors open (7C).
Figure 7B:
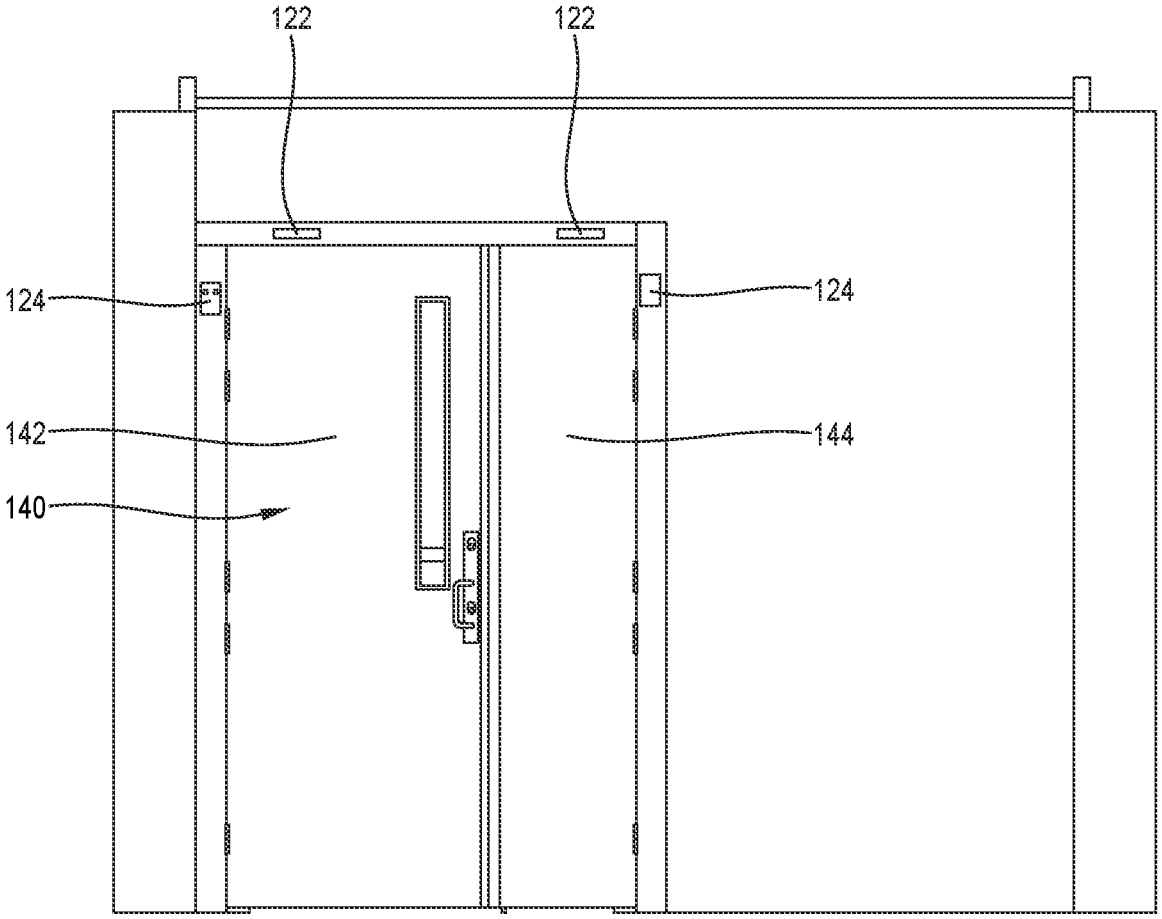
Figure 7C:
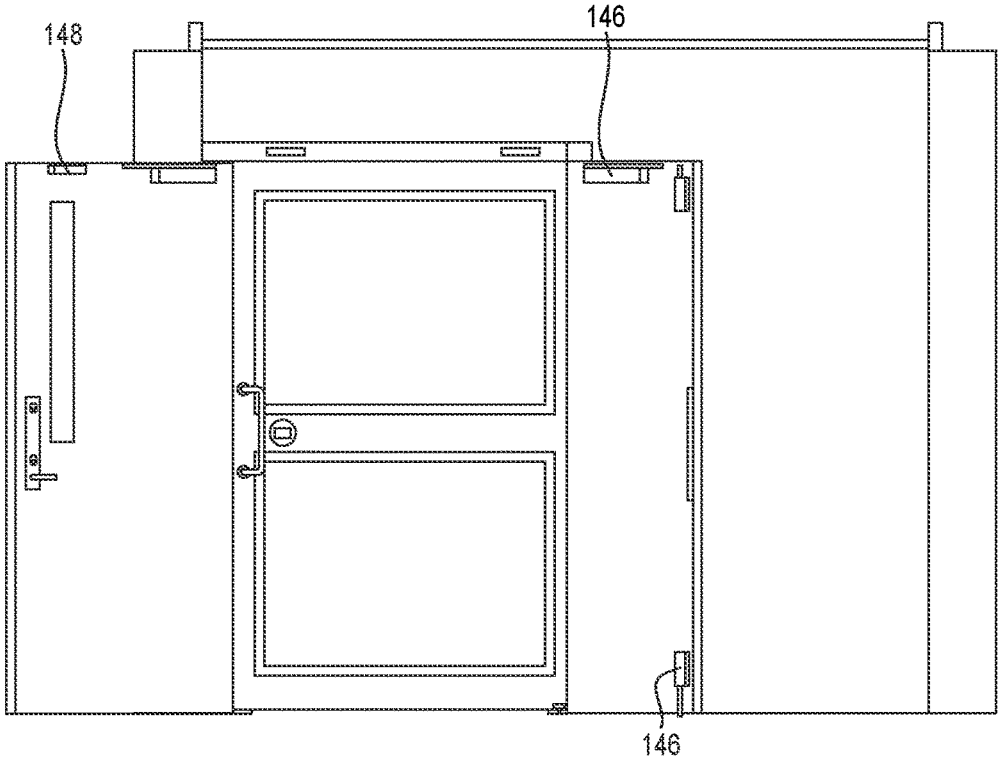

FIGS. 7A; 7B; and 7C and 8A; and 8B show two different embodiments of the secure sliding closure 100 implemented as a vault, or optionally a digital vault. The vaults are shown to comprise a visual alarm 122 disposed on the attack side, one or more aural alarm 124 on the attack side and a switch 120 for activation of the visual alarm and/or aural alarm on the secure side. The visual alarm 122 may comprise one or more light such as a strobe light, optionally a red strobe light. The one or more aural alarm 124 may comprise a hand operated bell.

Conventional vault hinged doors are generally extremely heavy, they are very heavy to close and open. This also places a large amount of weight to the structure holding the door into position especially when the door is open at 90 degrees. Advantageously, with closure 100 the weight is distributed evenly.

If the vault is required for day-time, secure doors may be installed for day to day access control. These doors add an additional layer of physical security and may be electronically monitored for afterhours use with door tampering alarms and the like.

Figure 8A:
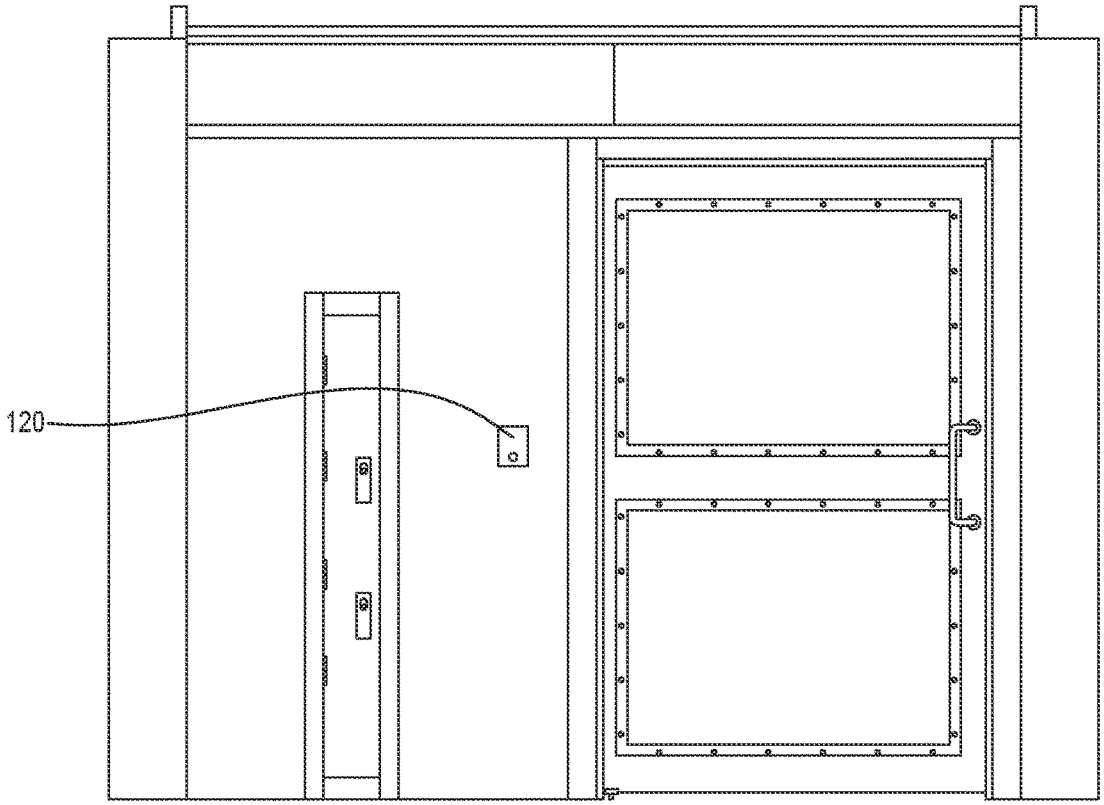
FIGS. 8A; and 8B: are schematic diagrams of another embodiment of the secure sliding door of the invention implemented in a vault showing a secure side (8A); and an attack side (8B).
Figure 8B:
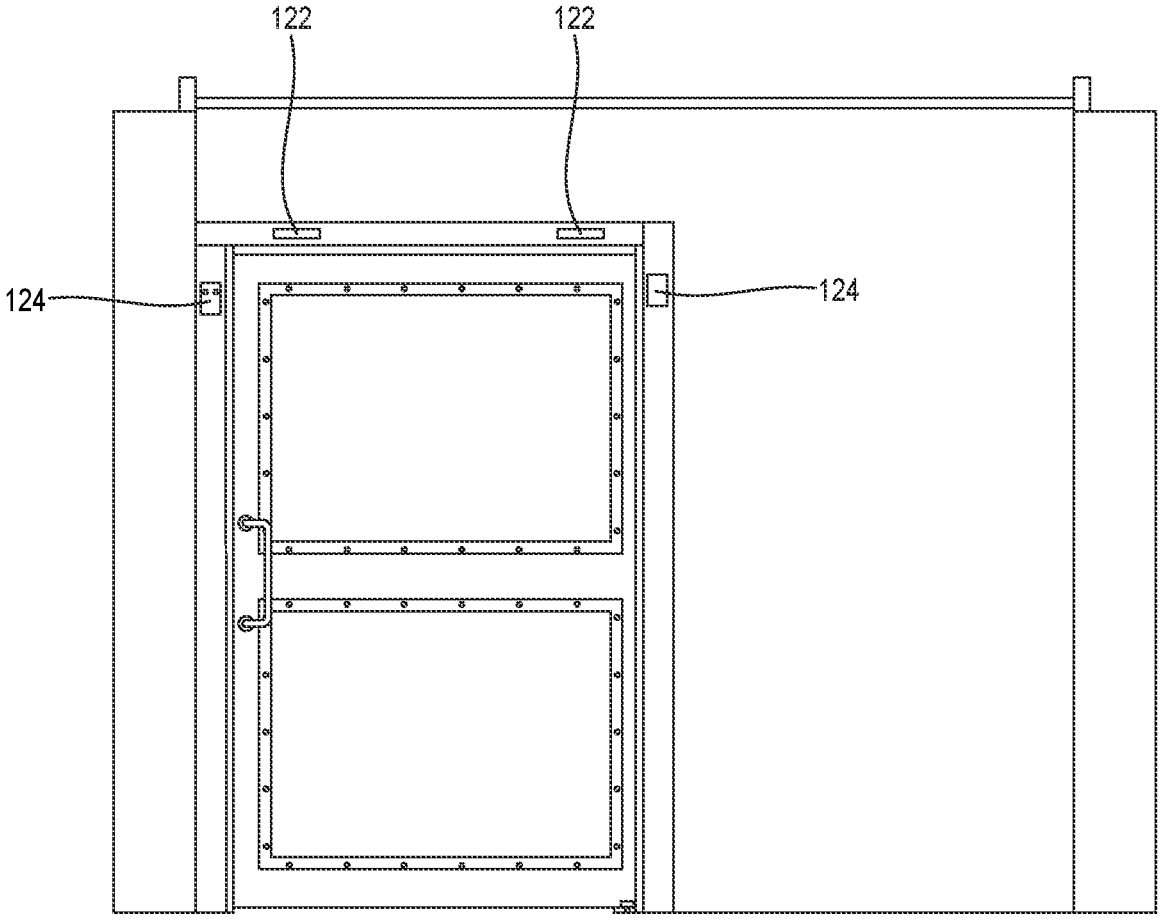

The embodiment shown in FIGS. 8A and 8B adds, to the attack side, swing doors 140 shown to comprise a main leaf 142 and an auxiliary leaf 144. The main leaf 142 is shown to comprise a magnetic lock and/or an electric strike or lock. The auxiliary leaf 144 is shown to comprise one or more lock bolts such as, a top lock bolt and bottom lock bolt.

This second vault embodiment has the vault lock only operates the mortice lock and dead lock on main leaf 142 of which when engaged disactivates the automatic door operator. Once the vault lock is disengaged the heavy vault door can be used as an access control door with swipe in or out.

With either vault embodiment, if someone is locked within the vault, the visual alarm 122, for example in the form of emergency red strobes, may provide a visual indication on the attack side, along with a hand operated bell to sound out for assistance.

Figure 9A:
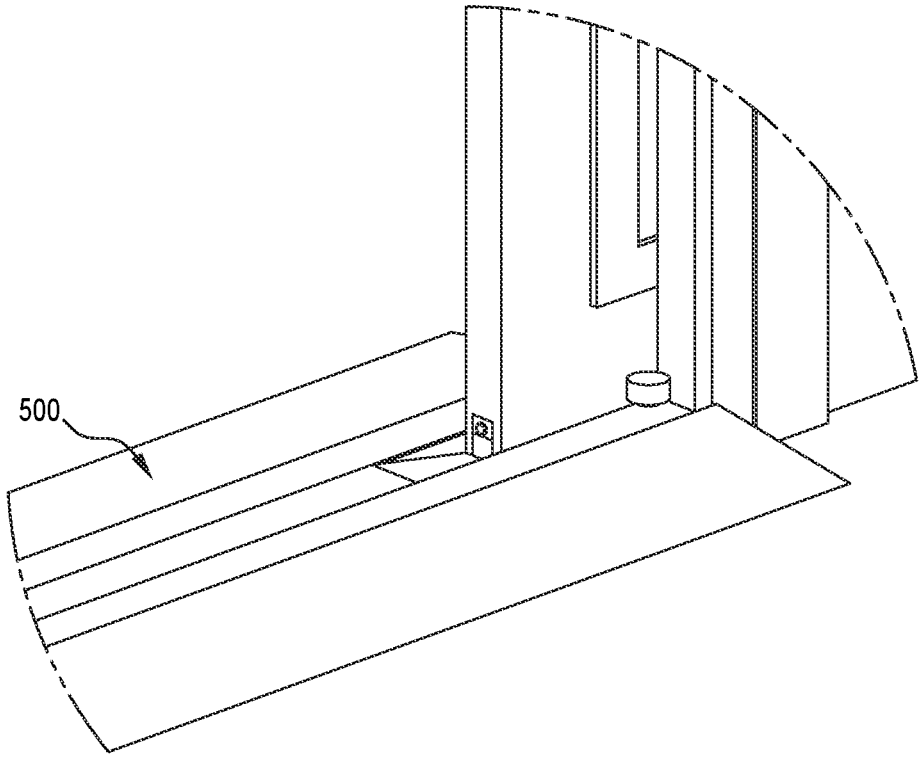
FIGS. 9A; 9B; 9C; 9D; 9E; 9F; and 9G: show a perspective view with sliding door open (9A); perspective view with sliding door closing (9B); perspective view of a threshold (9C); front view with seal closed (9D); front view with seal open (9E); side view with seal closed (9F); and side view with seal open (9G); of a threshold according to one embodiment of the invention.
Figure 9B:
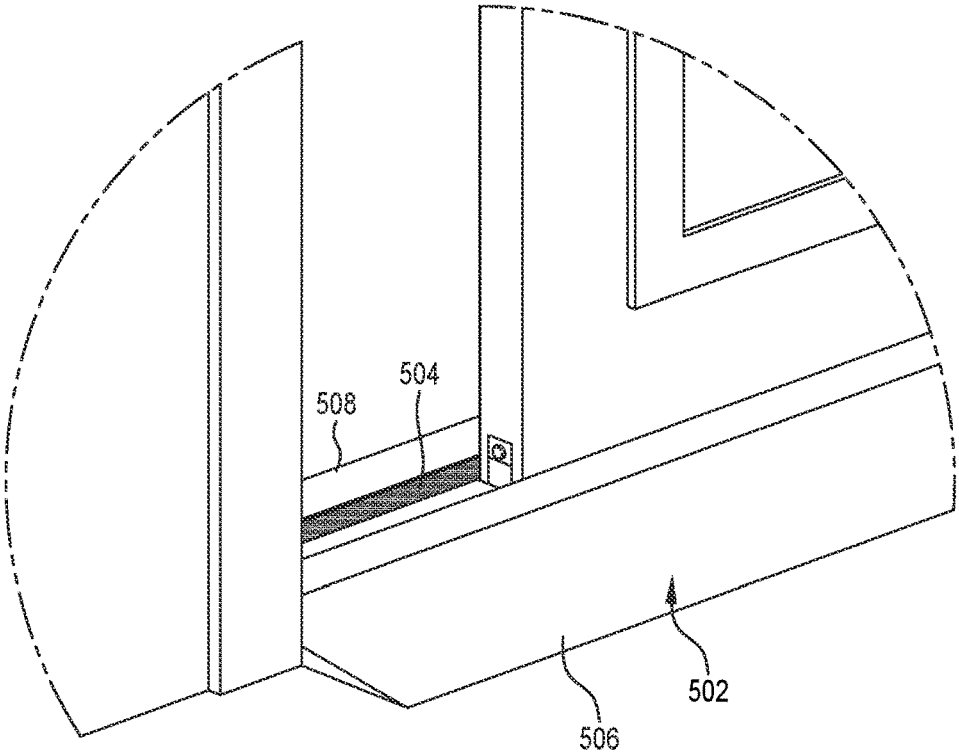
Figure 9C:
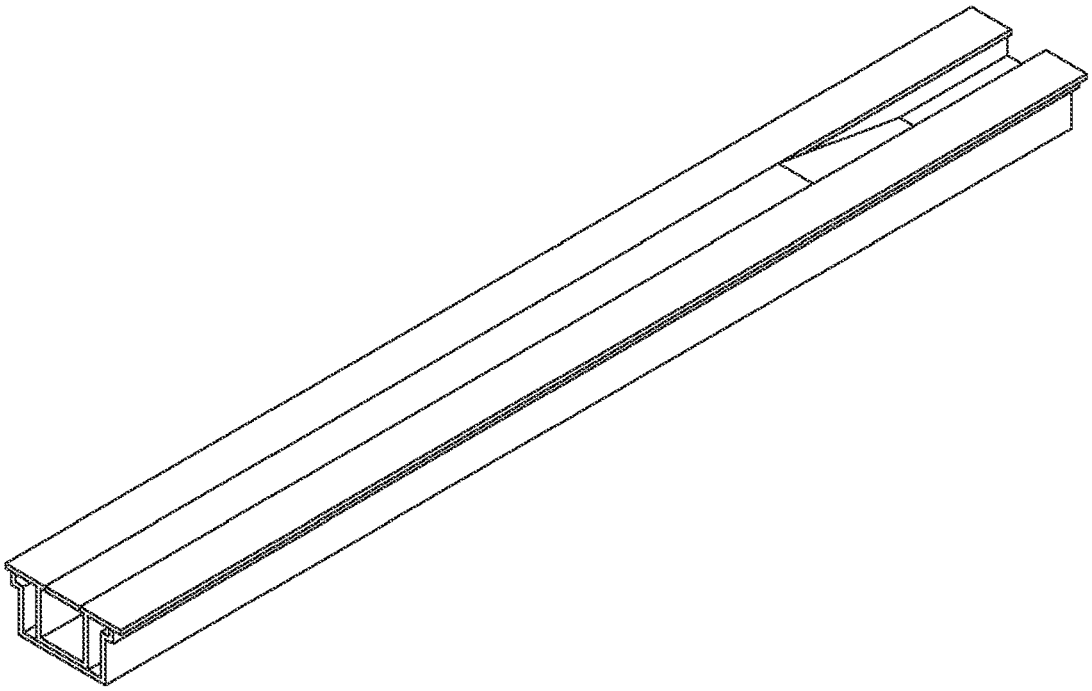
Figure 9D:
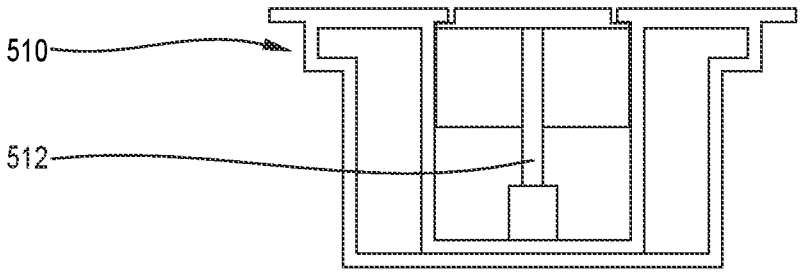
Figure 9E:
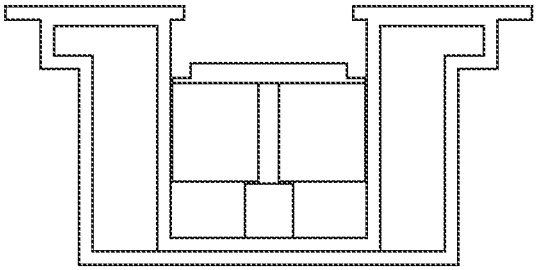
Figure 9F:
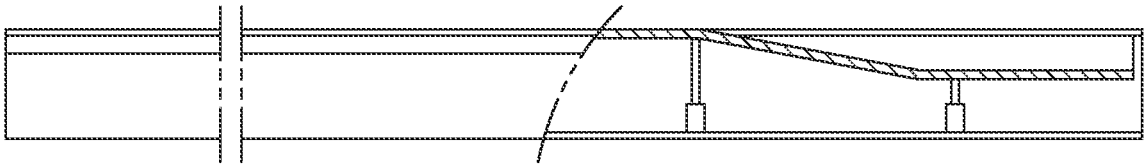
Figure 9G:
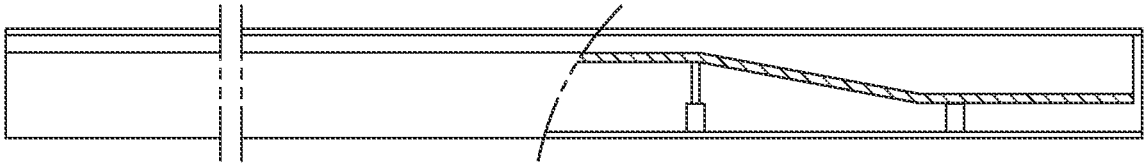

FIGS. 9A; 9B; 9C; 9D; 9E; 9F; and 9G show secure sliding closure 100 to comprise a threshold 500 comprising a threshold bottom plate 502 disposed underneath the sliding leaf 302. The threshold bottom plate 502 comprises a seal 510 which comprises one or more guide 512 which are biased, optionally spring loaded. Threshold 500 is shown to comprise a central channel 504 and an attack side flange 506 and a secure side flange 508 on respective sides of the central channel 504.

Door 300 sits above threshold 500 as normal with T-Section (central channel 504 and an attack side flange 506 and a secure side flange 508) installed onto the bottom of the door 300. The protruding T section is housed with the threshold track.

Provision of the threshold has the advantages of reduced ballistic under door vulnerability and additional door strength and/or integrity from forward impact, including blasts.

The invention also provides a method of manufacturing a secure sliding closure 100 along with a method of installing or retrofitting secure sliding closure 100.

Advantageously, secure sliding closure 100 may be provided in kit form.

As will be readily apparent from the disclosure herein, secure sliding closure makes it possible to secure access to one or more room or area.

The following non-limiting examples illustrate the invention. These examples should not be construed as limiting: the examples are included for the purposes of illustration only. The Examples will be understood to represent an exemplification of the invention.

EXAMPLES

Throughout the specification the aim has been to describe the invention without limiting the invention to any one embodiment or specific collection of features. Persons skilled in the relevant art may realize variations from the specific embodiments that will nonetheless fall within the scope of the invention.

An attempt to breach the secure sliding closure shown in FIGS. 1; 2 and 3; was made by highly-trained recognised personnel using mechanical tools including specialised equipment designed to breach secure closures and possession of which is regulated by governing bodies. All attempts failed.

The invention claimed is:

1. A secure sliding closure comprising:

a modular frame defining a secure cavity and a portal, the modular frame comprising a main frame and a door frame, the main frame comprising a frame upright spaced apart from a portal upright, and a top plate extending between the frame upright and the portal upright, the frame upright comprising a frame upright stud and a frame upright support post and the portal upright comprising a portal upright stud and portal upright support post, the frame upright stud and the portal upright stud comprising a heavy gauge steel stud, the main frame further comprising a frame upright floor mounting member and a portal upright floor mounting member for fastening the main frame to a floor with one or more main frame floor fastener and a frame upright head mounting member and a portal upright head mounting member for fastening the main frame to a soffit with one or more fastener, the main frame also comprising a subframe comprising one or more horizontal members, the subframe at least partially enclosing the secure cavity, the main frame comprising an attack side on which is disposed one or more modular frame security panels covering or partially covering the secure cavity, the door frame comprising a locking side upright spaced apart from a secure cavity upright and a door frame top plate extending between the locking side upright and the secure cavity upright, a bottom plate extending between the frame upright and the secure cavity upright or between the frame upright and the portal upright, the modular frame defining the secure cavity between the frame upright and the secure cavity upright and defining the portal between the secure cavity upright and the locking side upright; and a sliding door comprising a sliding leaf and a sliding leaf covering disposed on the sliding leaf, the covering comprising one or more sliding door security panel, the sliding leaf disposed for sliding from within the secure cavity to across the portal to prevent access through the portal, the sliding door also comprising one or more sliding door lock body cavity for housing one or more sliding door lock body, the sliding door lock body comprising one or more sliding door locks which engage with a door frame strikeplate disposed on the locking side upright;

wherein the frame upright, the portal upright, the top plate, the frame upright floor mounting member, the portal upright floor mounting member, the frame upright head mounting member, the portal upright head mounting member, the one or more horizontal members, the locking side upright, the secure cavity upright, the bottom plate and the door frame top plate are comprised of rectangular hollow section steel.

2. The secure sliding closure according to claim 1 wherein the one or more sliding door comprises double sliding doors.

3. The secure sliding closure according to claim 1 wherein the secure sliding closure further comprises a threshold bottom plate disposed underneath the sliding leaf.

4. The secure sliding closure according to claim 1 wherein the one or more modular frame security panels cover or partially cover any other part of the secure sliding closure.

5. The secure sliding closure according to claim 1 wherein the sliding leaf comprises an attack side and a secure side and wherein the sliding leaf comprises a sliding leaf frame.

6. The secure sliding closure according to claim 1 wherein any two or more components of the modular frame are welded together.

7. The secure sliding closure according to claim 1 further comprising a power connection.

8. A vault comprising:

the secure sliding closure of claim 1.

9. The secure sliding closure according to claim 1 wherein any two or more components of the modular frame are bolted together.

10. The secure sliding closure according to claim 9 wherein any two or more components of the modular frame are welded together.

11. A method of manufacturing a secure sliding closure, the method comprising:

producing a modular frame defining a secure cavity and a portal, the modular frame comprising a main frame and a door frame, the main frame comprising a frame upright spaced apart from a portal upright and a top plate extending between the frame upright and the portal upright, the frame upright comprising a frame upright stud and a frame upright support post and the portal upright comprising a portal upright stud and portal upright support post, the frame upright stud and the portal upright stud comprising a heavy gauge steel stud, the main frame further comprising a frame upright floor mounting member and a portal upright floor mounting member for fastening the main frame to a floor with one or more main frame floor fastener and a frame upright head mounting member and a portal upright head mounting member for fastening the main frame to a soffit with one or more fastener, the main frame also comprising a subframe comprising one or more horizontal members, the subframe at least partially enclosing the secure cavity, the main frame comprising an attack side on which is disposed one or more modular frame security panels covering or partially covering the secure cavity, the door frame comprising a locking side upright spaced apart from a secure cavity upright and a door frame top plate extending between the locking side upright and the secure cavity upright, a bottom plate extending between the frame upright and the secure cavity upright or between the frame upright and the portal upright, the modular frame defining the secure cavity between the frame upright and the secure cavity upright and defining the portal between the secure cavity upright and the locking side upright; and making a sliding door comprising a sliding leaf and a sliding leaf covering disposed on the sliding leaf, the covering comprising one or more sliding door security panel, the sliding leaf disposed for sliding from within the secure cavity to across the portal to prevent access through the portal, the sliding door also comprising one or more sliding door lock body cavities for housing one or more sliding door lock bodies, the sliding door lock body comprising, one or more sliding door locks which engage with a door frame strikeplate disposed on the locking side upright;

wherein the frame upright, the portal upright, the top plate, the frame upright floor mounting member, the portal upright floor mounting member, the frame upright head mounting member, the portal upright head mounting member, the one or more horizontal members, the locking side upright, the secure cavity upright, the bottom plate and the door frame top plate are comprised of rectangular hollow section steel.

12. The method according to claim 11 wherein one or more modular frame security panels cover or partially cover any other part of the secure sliding closure.

13. A method of installing or retrofitting a secure sliding closure, the method comprising:

installing or retrofitting a modular frame defining a secure cavity and a portal, the modular frame comprising a main frame and a door frame, the main frame comprising a frame upright spaced apart from a portal upright and a top plate extending between the frame upright and the portal upright the frame upright comprising a frame upright stud and a frame upright support post and the portal upright comprising a portal upright stud and portal upright support post, the frame upright stud and the portal upright stud comprising a heavy gauge steel stud, the main frame further comprising a frame upright floor mounting member and a portal upright floor mounting member for fastening the main frame to a floor with one or more main frame floor fastener and a frame upright head mounting member and a portal upright head mounting member for fastening the main frame to a soffit with one or more fastener, the main frame also comprising a subframe comprising one or more horizontal members, the subframe at least partially enclosing the secure cavity, the main frame comprising an attack side on which is disposed one or more modular frame security panels covering or partially covering the secure cavity, the a door frame comprising a locking side upright spaced apart from a secure cavity upright and a door frame top plate extending between the locking side upright and the secure cavity upright, a bottom plate extending between the frame upright and the secure cavity upright or between the frame upright and the portal upright, the modular frame defining the secure cavity between the frame upright and the secure cavity upright and defining the portal between the secure cavity upright and the locking side upright; and installing or retrofitting a sliding door comprising a sliding leaf and a sliding leaf covering disposed on the sliding leaf, the covering comprising one or more sliding door security panel, the sliding leaf disposed for sliding from within the secure cavity to across the portal to prevent access through the portal, the sliding door also comprising one or more sliding door lock body cavity for housing one or more sliding door lock body, the sliding door lock body comprises one or more sliding door locks which engage with a door frame strikeplate disposed on the locking side upright;

wherein the frame upright, the portal upright, the top plate, the frame upright floor mounting member, the portal upright floor mounting member, the frame upright head mounting member, the portal upright head mounting member, the one or more horizontal members, the locking side upright, the secure cavity upright, the bottom plate and the door frame top plate are comprised of rectangular hollow section steel.

* * * * *